US005349933A

United States Patent [19]

Hasegawa et al.

[11] Patent Number: 5,349,933

[45] Date of Patent: Sep. 27, 1994

[54] FUEL METERING CONTROL SYSTEM IN INTERNAL COMBUSTION ENGINE

[75] Inventors: Yusuke Hasegawa; Shusuke Akazaki; Isao Komoriya; Hidetaka Maki; Toshiaki Hirota, all of Saitama, Japan

[73] Assignee: Honda Giken Kogyo Kabushiki Kaisha, Tokyo, Japan

[21] Appl. No.: 137,344

[22] Filed: Oct. 18, 1993

[30] Foreign Application Priority Data

| | | | |
|---|---|---|---|
| Oct. 19, 1992 | [JP] | Japan | 4-306086 |
| Jun. 30, 1993 | [JP] | Japan | 5-186850 |
| Jul. 30, 1993 | [JP] | Japan | 5-208835 |

[51] Int. Cl.[5] ..... F02D 41/10

[52] U.S. Cl. ..... 123/486; 123/492

[58] Field of Search ..... 123/478, 480, 486, 492, 123/493, 494

[56] References Cited

U.S. PATENT DOCUMENTS

| | | | |
|---|---|---|---|
| 4,805,579 | 2/1989 | Toshimitsu et al. | 123/492 |
| 4,823,755 | 4/1989 | Hirose et al. | 123/486 X |
| 4,907,556 | 3/1990 | Ishii et al. | 123/478 X |
| 4,949,694 | 8/1990 | Nagaishi et al. | 123/486 X |
| 4,967,715 | 11/1990 | Hosaka | 123/478 X |
| 4,996,960 | 3/1991 | Nishiyama et al. | 123/492 X |
| 5,035,225 | 7/1991 | Mizukoshi | 123/492 |
| 5,134,981 | 8/1992 | Takahashi et al. | 123/492 X |

FOREIGN PATENT DOCUMENTS 2-157451 6/1990 Japan .

*Primary Examiner*—Willis R. Wolfe

*Attorney, Agent, or Firm*—Nikaido, Marmelstein, Murray & Oram

[57] ABSTRACT

A system for controlling fuel metering in an internal combustion engine using a fluid dynamic model and the cylinder air flow past the throttle is determined therefrom. Based on the observation that the difference between a steady-state engine operating condition and a transient engine operating condition can be described as the difference in the effective throttle opening areas, the amount of fuel injection is determined from the product of the ratio between the areas and a basic fuel injection amount under the steady-state engine operating condition obtained by mapped data retrieval and by subtracting a correction amount corresponding to an air flow filling a chamber between the throttle and the cylinder from the product. Under steady-state engine operation, the correction amount becomes zero. In an embodiment, the first-order lag of a detected throttle opening is calculated and based on the value, various parameters including a pseudo manifold pressure are obtained so as to solve sensors' detection timing lag or a pressure sensor's detection lag.

55 Claims, 20 Drawing Sheets

FIG. 9

| | Pb |
|---|---|
| Ne | Desired A/F |

FIG. 12

| | ΔPb |
|---|---|
| Desired A/F | ΔTi |

FUEL METERING CONTROL SYSTEM IN INTERNAL COMBUSTION ENGINE

BACKGROUND OF THE INVENTION

1. Field of the Invention

This invention relates to a system for controlling fuel metering in an internal combustion engine, more particularly to a system for controlling fuel metering in an internal combustion engine wherein the amount of fuel injection is optimally determined over entire range of engine operating conditions including engine transients using an intake air model and by simplifying its calculation, while coping with various instances such as system degradation and initial manufacturing variances.

2. Description of the Prior Art

In a conventional fuel metering control system, the fuel injection amount was usually determined by retrieving mapped data predetermined through experimentation and stored in advance in a microcomputer memory using parameters having high degrees of correlation with the engine cylinder air flow. As a result, the conventional technique was utterly powerless to cope with the parameters' change which had not been taken into account at the time of preparing the mapped data. The same difficulty could also be encountered due to the degradation and initial manufacturing variance etc. in the fuel metering control system. Further, since the mapped data were intrinsically prepared solely focussing on steady-state engine operating conditions and transient conditions were not described there, the conventional technique was unable to determine the fuel injection amount under engine transients with accuracy. For that reason, there are recently proposed techniques to establish a fluid dynamic model describing the behavior of the air intake system so as to accurately estimate cylinder air flow such as disclosed in Japanese Laid-Open Patent Publication 2(1988)-157,451 or U.S. Pat. No. 4,446,523.

Also the assignee proposed in Japanese Patent Application 4(1992)-200,330 a method for estimating cylinder air flow by determining the air mass flow past the throttle while treating the throttle as an orifice to establish a fluid dynamic model based on standard orifice equations for compressible fluid flow. The fluid dynamic model used there is, however, premised on an ideal state and requires various assumptions. It is therefore impossible to wipe out all the errors which could be introduced at the time of modeling. Further, since it is quite difficult to accurately determine constants such as specific-heat ratio used in the model, errors arising possibly therefrom may disadvantageously be accumulated. Furthermore, the equations necessitate calculation of powers, roots or the like. Since approximate values are used for them in practice, resulting additional errors.

SUMMARY OF THE INVENTION

An object of the invention is therefore to solve the drawbacks in the prior art and to provide a system for controlling fuel metering in an internal combustion engine wherein fuel metering is optimally controlled based on a fluid dynamic model, coping with engine transients and system degradation or initial manufacturing variances while eliminating complicate calculations and modeling errors.

For realizing the objects, the present invention provides a system for controlling fuel metering in an internal combustion engine on the basis of the air flowing to a cylinder of the engine determined on a fluid dynamic model describing the behavior of the air passing through a throttle provided in an air intake system of the engine. The system comprises a first means for detecting operating parameters of the engine at least including engine speed, manifold pressure and throttle opening; a second means for determining a fuel injection amount Ti corresponding to the throttle-past air flow Gth under a steady-state engine operating condition at least from the engine speed and manifold pressure in accordance with a first predetermined characteristic, treating the difference between the steady-state engine operating condition and a transient engine operating condition as a difference in effective throttle opening areas; a third means for determining an effective throttle opening area A1 under the steady-state engine operating condition in accordance with a second characteristic; a fourth means for determining a current effective throttle opening area A2 on the basis of the throttle opening and manifold pressure to determine a ratio A2/A1 between the effective throttle opening areas A1, A2; a fifth means for multiplying the determined basic fuel injection amount Ti by the ratio A2/A1 to determine an output injection amount Tout; and a sixth means for driving an injector to open for a period corresponding to the determined output fuel injection amount.

The invention still further includes a system for controlling fuel metering in an internal combustion engine on the basis of the air flowing to a cylinder of the engine determined on a fluid dynamic model describing the behavior of the air passing through a throttle provided in an air intake system of the engine. The system comprises a first means for detecting operating parameters of the engine at least including engine speed, manifold pressure and throttle opening; a second means for determining a basic fuel injection amount Ti corresponding to the throttle-past air flow Gth under a steady-state engine operating condition and an effective throttle opening area A1 under the steady-state engine operating condition from the engine speed and manifold pressure in accordance with predetermined first and second characteristics, treating the difference between the steady-state engine operating condition and a transient engine operating condition as a difference in the effective throttle opening areas; a third means for determining a current effective throttle opening area A2 on the basis of the throttle opening and manifold pressure; a fourth means for obtaining the change of the manifold pressure to determine an air flow delta Gb filling a chamber defined from downstream of the throttle to a portion immediately before the cylinder of the engine at least from the change of the manifold pressure on the basis of the ideal gas law, and then by dividing the chamber filling air flow delta Gb by a desired air/fuel ratio A/F to determine a correction amount delta Ti (=delta Gb/(A/F)) corresponding to the chamber filling air flow delta Gb; a fifth means for obtaining a ratio A2/A1 between the effective throttle opening areas A1, A2 and for multiplying the determined basic fuel injection amount Ti by the ratio A2/A1 and by subtracting from the product the correction amount delta Ti to determine an output fuel injection amount Tout; and a sixth means for driving a injector to open for a period corresponding to the determined output fuel injection amount Tout.

The invention can yet further include a system for controlling fuel metering in an internal combustion engine on the basis of the air flowing to a cylinder of the engine determined on a fluid dynamic model describing the behavior of the air passing through a throttle provided in an air intake system of the engine. The system comprises a first means for detecting operating parameters of the engine at least including engine speed, manifold pressure and throttle opening; a second means for determining a fuel injection amount Timap under a steady-state engine operating condition at least from the engine speed and manifold pressure in accordance with a predetermined first characteristic; a third means for determining a first effective throttle opening area A at least from a value obtained from the throttle opening; a fourth means for obtaining a second effective throttle opening area ADELAY in accordance with a predetermined second characteristic; a fifth means for obtaining a ratio A/ADELAY between the first and second effective throttle opening areas A, ADELAY and for multiplying the determined fuel injection amount Timap by the ratio A/ADELAY to determine an output fuel injection amount Tout from the product as Tout=Timap×(A/ADELAY); and a sixth means for driving an injector to open for a period corresponding to the output fuel injection amount Tout.

BRIEF DESCRIPTION OF THE DRAWINGS

These and other objects and advantages of the invention will be more apparent from the following description and drawings, in which:

FIG. 9 is a view explaining mapped data of a desired air/fuel ratio predetermined with respect to engine speed Ne and manifold pressure Pb;

FIG. 12 is a view explaining mapped data of a correction amount delta Ti predetermined with respect to the desired air/fuel ratio and manifold pressure change Pb;

DETAILED DESCRIPTION OF THE PREFERRED EMBODIMENTS

The embodiments of the invention will now be explained with reference to the drawings.

Figure 1:
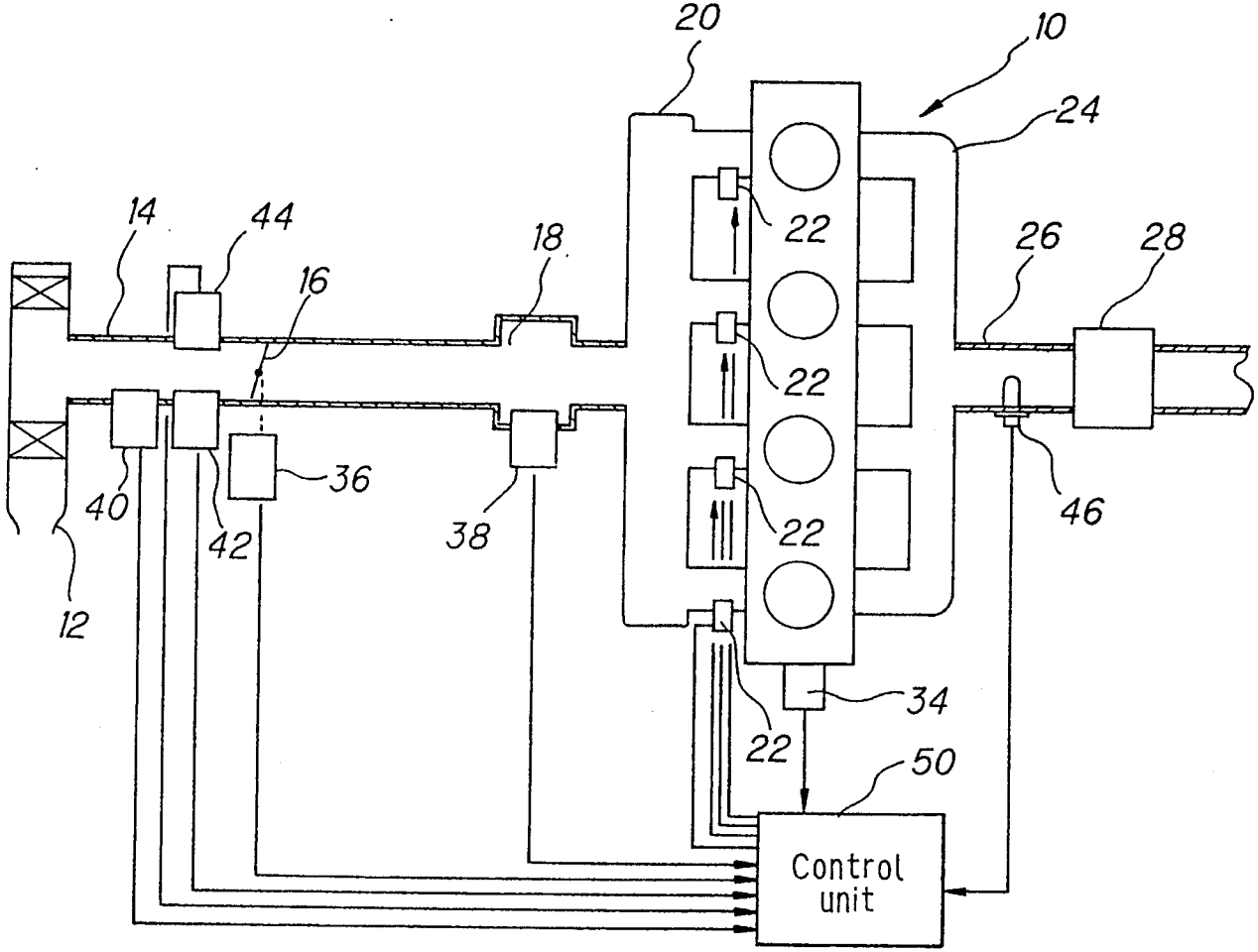
FIG. 1 is an overall block diagram showing a fuel metering control system according to the invention.

An overall view of the fuel metering control system according to the first embodiment of the invention is shown in FIG. 1. Reference numeral 10 in this figure designates a four cylinder internal combustion engine. Air drawn in through an air cleaner 12 mounted on the far end of an air intake path 14 is supplied to first to fourth cylinders through a surge tank (chamber) 18 and an intake manifold 20 while the flow thereof is adjusted by a throttle valve 16. An injector 22 for injecting fuel is installed in the vicinity of the intake valve (not shown) of each cylinder. The injected fuel mixes with the intake air flow to form an air-fuel mixture that is introduced and ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 24, from where it passes through an exhaust pipe 26 to a three-way catalytic converter 28 where it is cleared of noxious components before being discharged to atmosphere.

A crank angle sensor 34 for detecting the piston crank angles is provided in a distributor (not shown) of the internal combustion engine 10, a throttle position sensor 36 is provided for detecting the degree of opening $\theta$TH of the throttle valve 16, and a manifold absolute pressure sensor 38 is provided for detecting the absolute pressure Pb of the intake air downstream of the throttle valve 16. On the upstream side of the throttle valve 16 are provided with an atmospheric pressure sensor 40 for detecting the atmospheric (barometric) pressure Pa, an intake air temperature sensor 42 for detecting the temperature of the intake air and a hygrometer 44 for detecting the humidity of the intake air. An air/fuel ratio sensor 46 comprising an oxygen concentration detector is provided in the exhaust system at a point downstream of the exhaust manifold 24 and upstream of a three-way catalytic converter 28, where it detects the air/fuel ratio of the exhaust gas. The outputs of the sensor 34 etc. are sent to a control unit 50.

Figure 2:
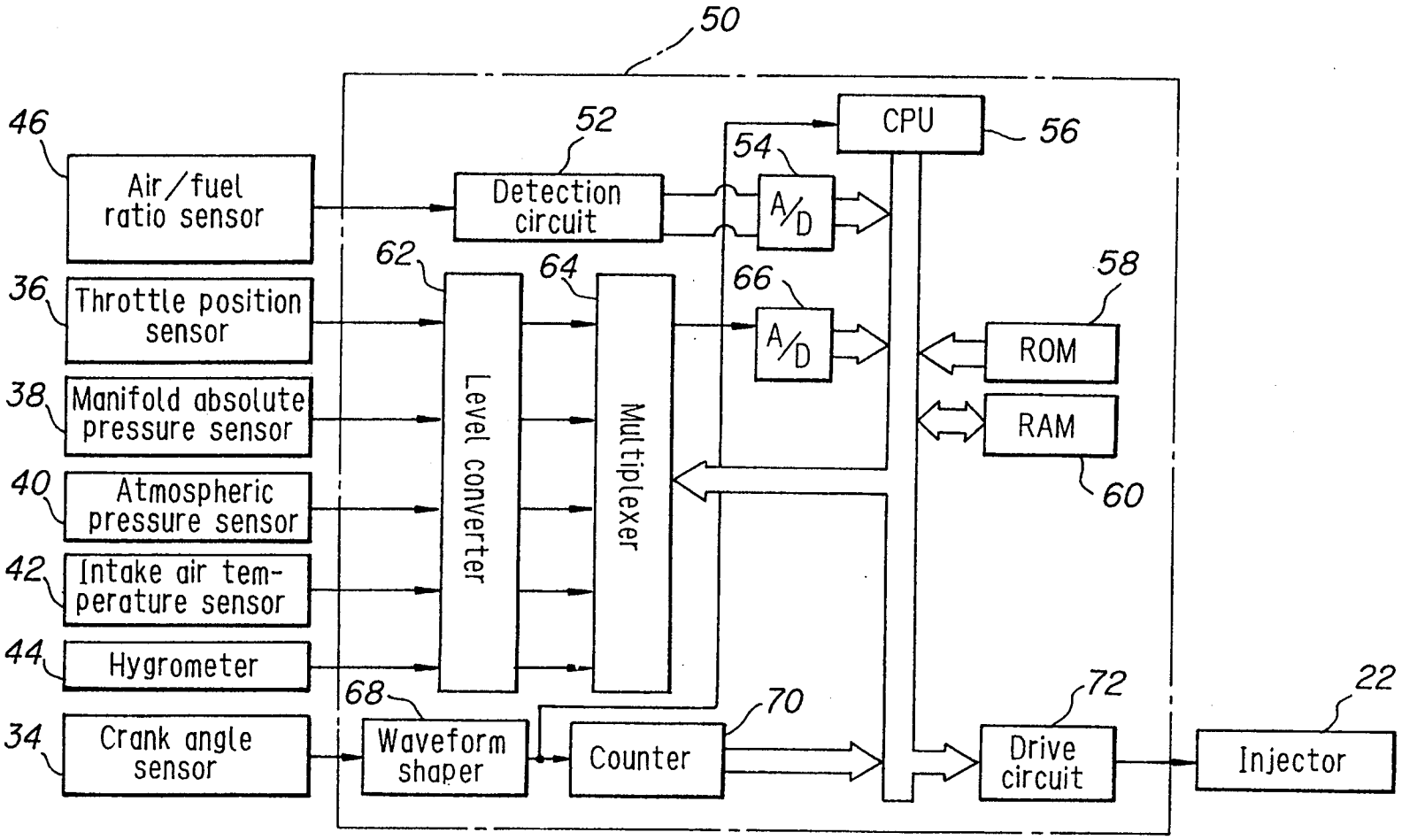
FIG. 2 is a block diagram showing the details of the control unit illustrated in FIG. 1.

Details of the control unit 50 are shown in the block diagram of FIG. 2. The output of the air/fuel ratio sensor 46 is received by a detection circuit 52 of the control unit 50, where it is subjected to appropriate linearization processing to obtain an air/fuel ratio characterized in that it varies linearly with the oxygen concentration of the exhaust gas over a broad range extending from the lean side to the rich side. The output of the detection circuit 52 is forwarded through an A/D (analog/digital) converter 54 to a microcomputer comprising a CPU (central processing unit) 56, a ROM (read-only memory) 58 and a RAM (random access memory) 60 and is stored in the RAM 60. Similarly, the analog outputs of the throttle position sensor 36 etc. are input to the microcomputer through a level converter 62, a multiplexer 64 and a second A/D converter 66, while the output of the crank angle sensor 34 is shaped by a waveform shaper 68 and has its output value counted by a counter 70, the result of the count being input to the microcomputer. In accordance with commands stored in the ROM 58, the CPU 56 of the microcomputer computes a control value in the manner to be explained later and drives the injector 22 of the individual cylinders via a drive circuit 72.

Figure 3:
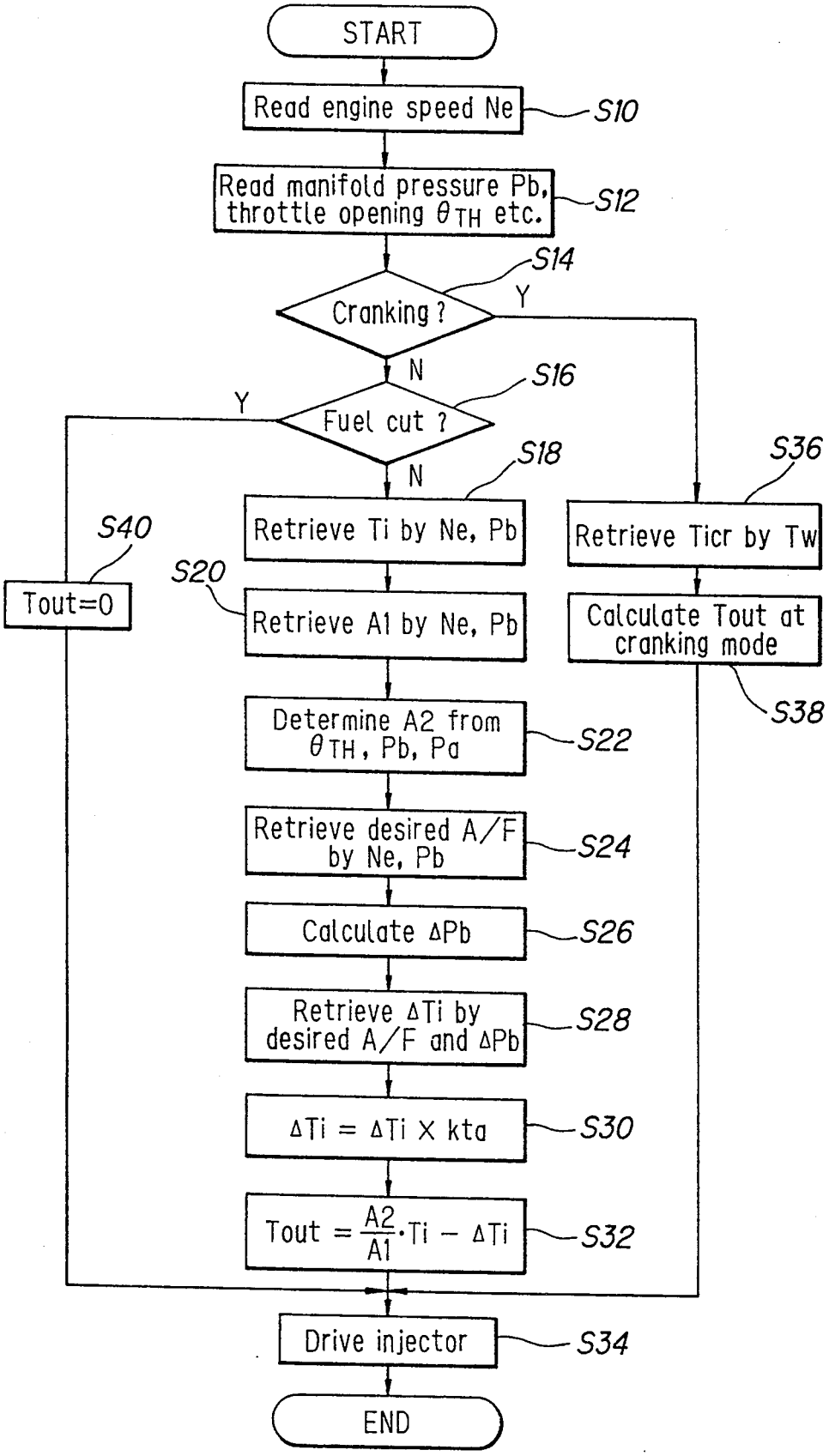
FIG. 3 is a flow chart showing the operation of the system.

FIG. 3 is a flow chart showing the operation of the system. Before entering into the explanation of the figure, however, cylinder air flow estimation using an air intake model on which the invention is based, will first be explained.

In the method, briefly stated, the throttle is viewed as an orifice to establish the air intake model, the mass of air past the throttle is estimated by conducting calculation based on the standard orifice equations. A delay in an air flow in filling a chamber defined between the throttle and the cylinder is then estimated and cylinder air flow is finally estimated. Since the method is fully described in the aforesaid assignee's earlier application, the explanation will be made in brief.

Figure 4:
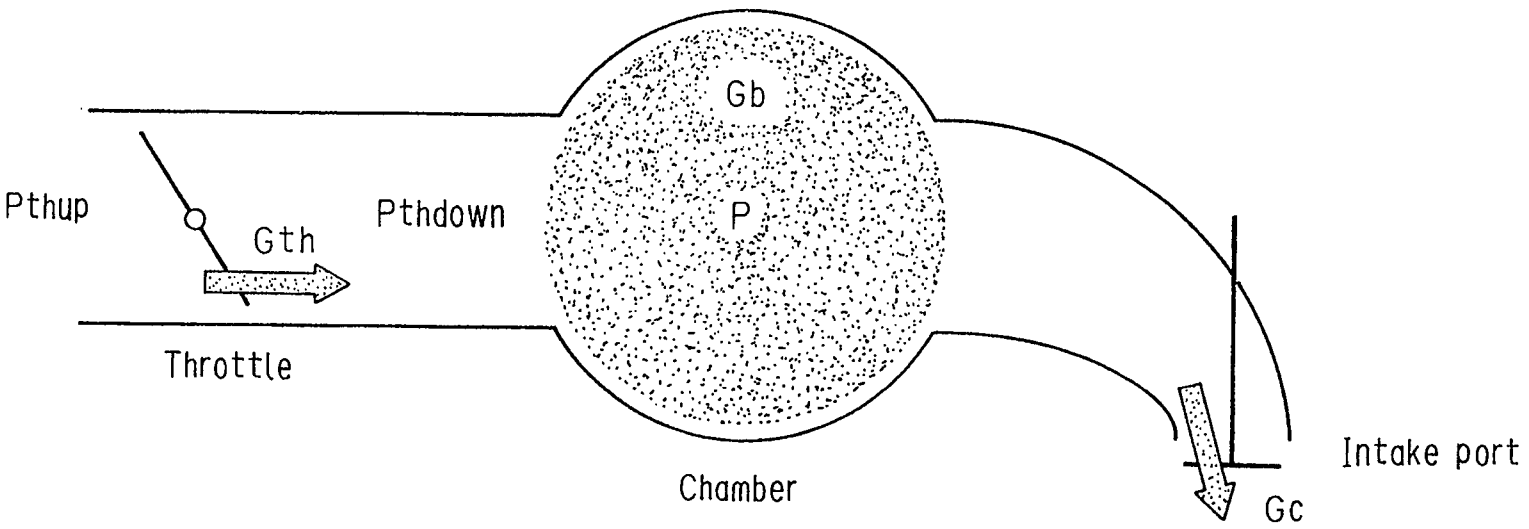
FIG. 4 is a view showing the air intake system model for estimating cylinder air flow to be used in the fuel metering control illustrated in FIG. 1.

Namely, if the throttle is viewed as an orifice as shown in the air intake system model of FIG. 4, it is possible from Eq. 1 Bernoulli's equation), Eq. 2 (equation of continuity) and Eq. 3 (relational equation of adiabatic process) to derive Eq. 4, which is the standard orifice equation for compressible fluid flow. Eq. 4 can be rewritten as Eq. 5 and based on it, it is thus possible to determine the air mass flow Gth through the throttle valve per unit time.

$$\frac{v_1^2}{2} + \frac{\kappa}{\kappa - 1} \cdot \frac{P_1}{\rho_1} = \frac{v_2^2}{2} + \frac{\kappa}{\kappa - 1} \cdot \frac{P_2}{\rho_2} \qquad \text{Eq. 1}$$

where the flow is assumed to be the adiabatic process, and $P_1$: Absolute pressure on upstream side
$P_2$: Absolute pressure on downstream side
$\rho_1$: Air density on upstream side
$\rho_2$: Air density on downstream side
$v_1$: Flow velocity on upstream side
$v_2$: Flow velocity on downstream side
$\kappa$: Specific-heat ratio $$\rho_1 \cdot v_1 \cdot A_{up} = \rho_2 \cdot v_2 \cdot S \qquad \text{Eq. 2}$$

where:

$A_{up}$: Flow passage area on upstream side
S: Throttle projection area [=f($\theta$TH)]

$$\frac{P_1}{\rho_1^{\kappa}} = \frac{P_2}{\rho_2^{\kappa}} \qquad \text{Eq. 3}$$

$$Gth = \epsilon \cdot \rho_1 \cdot \alpha \cdot S \cdot \sqrt{\frac{2g \cdot (P_1 - P_2)}{\gamma_1}} \qquad \text{Eq. 4}$$

where:

g: Gravitational acceleration
$\gamma_1$: Air specific weight on upstream side ($=\rho_1 \cdot g$)
$\alpha$: Flow rate coefficient (coefficient of discharge)

$$\left( = \frac{C_v \cdot C_c}{\sqrt{1 - C_c^2 (d/D)^4}} \right) \qquad \text{Eq. 5}$$

where:

$C_v$: Velocity coefficient
$C_c$: Contraction coefficient [$= f(S/A_{up})$]
$D$: Bore diameter on upstream side
$d$: Throttle aperture diameter $\epsilon$: Correction coefficient (expansion factor of gas)

$$\left( = \frac{\left(\frac{\kappa}{\kappa - 1}\right)\left(\left(\frac{P_2}{P_1}\right)^{(2/\kappa)} - \left(\frac{P_2}{P_1}\right)^{((\kappa+1)/\kappa)}\right)(1 - C_c^2 (d/D)^4)}{(1 - P_2/P_1)\left(1 - \left(\frac{P_2}{P_1}\right)^{(2/\kappa)} \cdot C_c^2 (d/D)^4\right)} \right)$$

$$Gth = \epsilon \cdot \rho_1 \cdot \alpha \cdot S \cdot \sqrt{\frac{2g \cdot (P_1 - P_2)}{\gamma_1}}$$

$$= C \cdot S \cdot \rho_1 \cdot \sqrt{\frac{2g \cdot (P_1 - P_2)}{\gamma_1}}$$

$$= A \cdot \rho_1 \cdot \sqrt{\frac{2g \cdot (P_1 - P_2)}{\gamma_1}}$$

$$\approx A \cdot \rho_1 \cdot \sqrt{\frac{2g \cdot (Pa - Pb)}{\gamma_1}}$$

where:

$C = \epsilon \cdot \alpha$
$A = C \cdot S$
S: Throttle projection area
A: Effective throttle opening area
Pa: Atmospheric pressure
Pb: Manifold absolute pressure More specifically, on the basis of the throttle opening $\theta$TH detected, the throttle's projection area S is determined in accordance with a predetermined characteristic, as illustrated in the block diagram of FIG. 5. Here, the throttle projection area S means the area formed on a plane perpendicular to the longitudinal direction of the air intake path 14 when the throttle valve 16 is assumed to be projected in that direction. At the same time, the discharge coefficient C which is the product of the flow rate coefficient alpha and gas expansion factor epsilon, is retrieved from mapped data whose characteristic is illustrated in FIG. 6 using the throttle opening θTH and manifold pressure Pb as address data, and the throttle projection area S is multiplied by the coefficient C retrieved to obtain the effective throttle opening area A.

According to Eq. 5, the value A is multiplied by the air specific weight rho 1 and the root to determine the throttle-past air mass flow Gth. Here, the pressures P1, P2 in the root can be substituted by atmospheric pressure Pa and manifold pressure Pb.

It should be noted here that since the throttle does not function as an orifice at its wide-open state, the full load openings are predetermined empirically as limited values with respect to engine speed. And if a detected throttle opening is found to exceed the limit value concerned, the detected value is restricted to the limit value.

Next, the mass of air in the chamber, referred hereinafter to as "Gb", is calculated by using Eq. 6, which is based on the ideal gas law. The term "chamber" is used here to mean not only the part corresponding to the so-called surge tank but to all portions extending from immediately downstream of the throttle to immediately before the cylinder intake port.

$$Gb(k) = \frac{V}{R \cdot T} \cdot P(k) \qquad \text{Eq. 6}$$

where:

V: Chamber volume
T: Air temperature
R: Gas constant
P: Pressure

Then, the change delta Gb in the mass of air in the chamber in the current cycle can be obtained from the pressure change using Eq. 7.

$$\Delta Gb = Gb(k) - Gb(k-1) = \frac{V}{R \cdot T} \cdot (P(k) - P(k-1)) = \frac{V}{R \cdot T} \cdot \Delta P(k) \qquad \text{Eq. 7}$$

If it is assumed that the mass of air filling the chamber is not, as a matter of fact, inducted into the cylinder, then the actual cylinder air flow Gc per time unit delta T can be expressed as Eq. 8, whereby it becomes possible to estimate the dynamic behavior of the actual cylinder air flow.

$$Gc = Gth \cdot \Delta T - \Delta Gb \qquad \text{Eq. 8}$$

Figure 7:
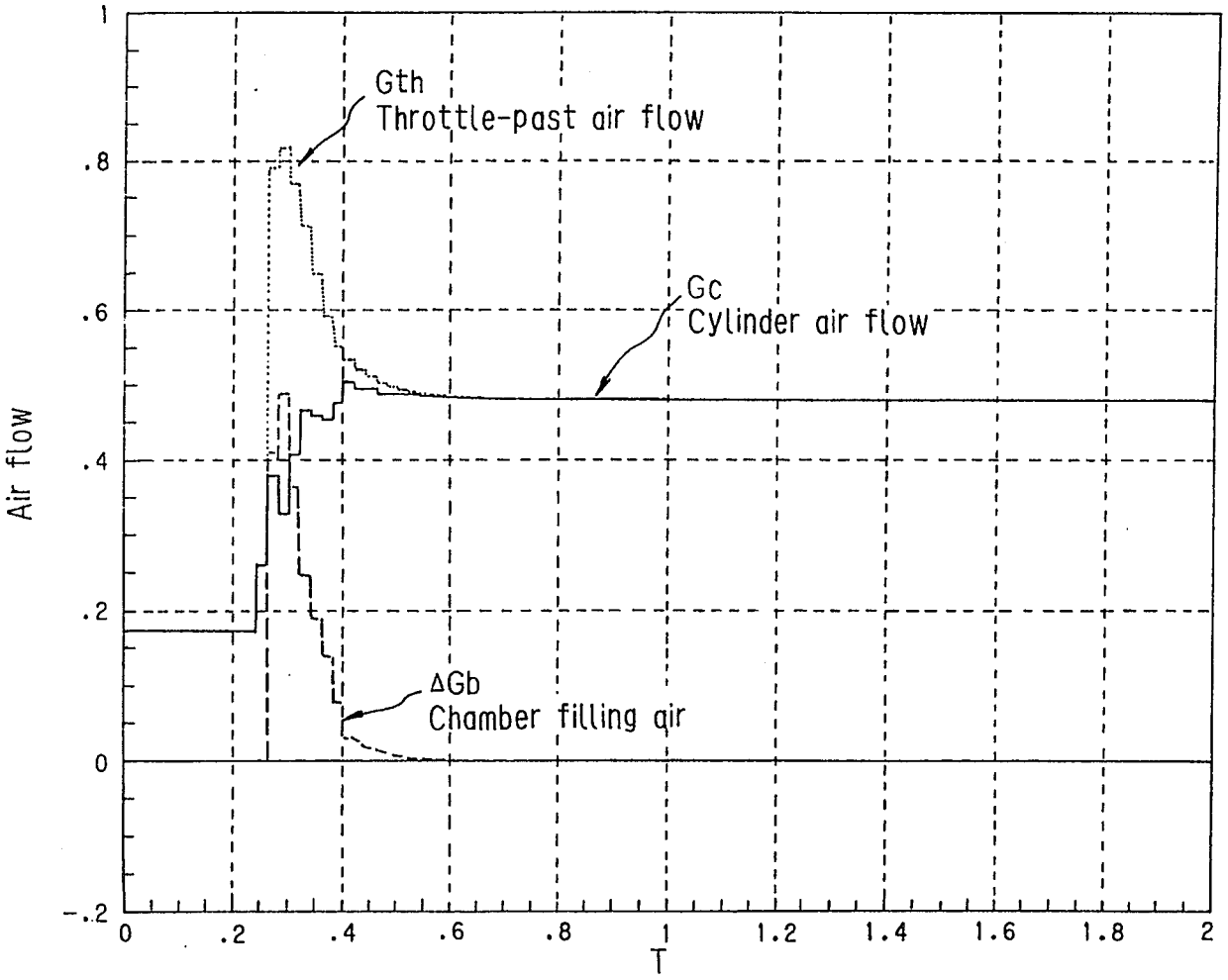
FIG. 7 is a view showing computer simulation results of the cylinder air flow estimated using the model of FIG. 4.

FIG. 7 shows the results of computer simulation using this method.

Figure 8:
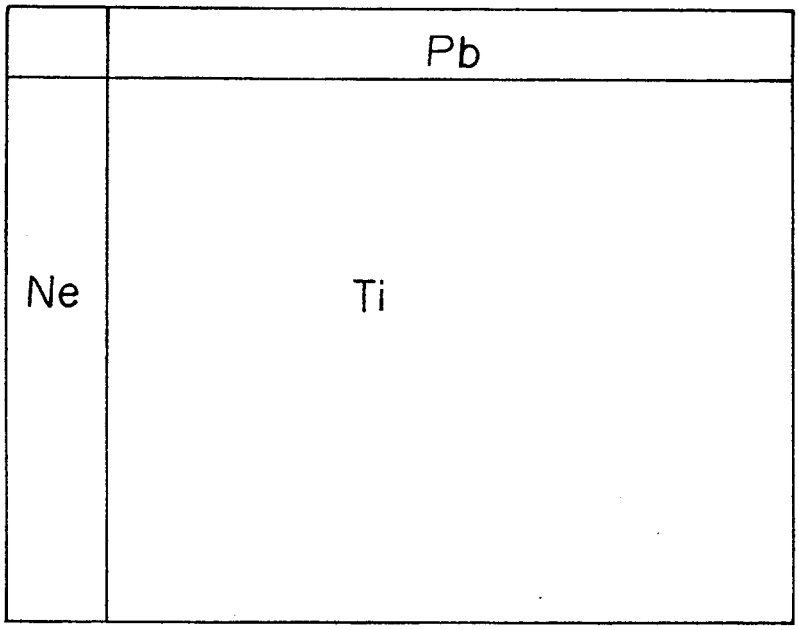
FIG. 8 is a view explaining mapped data of a basic fuel injection amount Ti predetermined with respect to engine speed Ne and manifold pressure Pb.

On the other hand, the basic fuel injection amount Ti is prepared in advance in accordance with the so-called speed density method and stored in the ROM 58 as mapped data with respect to engine speed Ne and manifold pressure Pb as illustrated in FIG. 8. The basic fuel injection amount Ti is established in the mapped data in response to an air/fuel ratio desired which in turn is determined in response to the engine speed Ne and the manifold pressure Pb. The desired air/fuel ratio is therefore prepared in advance and stored as mapped data with respect to the same parameters as shown in FIG. 9, which will be used for determining an amount delta Ti for correcting the basic fuel injection amount Ti at a later stage.

It should here be noted that the basic fuel injection amount Ti is established such that it satisfies the aforesaid fluid dynamic model under steady-state engine operating conditions. Additionally, the fuel injection amount Ti is established in terms of opening period of the injector 22. It should further be noted that in the specification, the mapped data means look-up tables retrieved by two parameters and a table means a look-up table retrieved by a parameter.

Here, attention is paid to the relationship between the basic fuel injection amount Ti retrieved from the mapped data and air mass flow Gth past the throttle. In a certain aspect defined by an engine speed Nel and an manifold pressure Pbl under state-state engine operations, the basic fuel injection amount retrieved from the mapped data, here referred to as Ti1, will be expressed as Equation 9.

$$Ti1 = \text{MAPPED DATA (Nel, Pbl)} \ldots \text{Eq. 9}$$

At that situation, the fuel injection amount determined theoretically from the aforesaid fluid dynamic model, here referred to as Ti1′ (with dash), will be expressed as Equation 10 when desired air/fuel ratio is set to be the stoichiometric air/fuel ratio (14.7 : 1).

$$Ti1' = Gth1 \cdot \Delta T/14.7 \qquad \text{Eq. 10}$$

where $$Gth1 = A1 \cdot \rho 1 \cdot \sqrt{2g \frac{Pa - Pb1}{\gamma_1}}$$

Since the mapped data are prepared such that they satisfy the model equations as were mentioned before, the basic fuel injection amount Ti1 retrieved from the mapped data and the fuel injection amount Ti1′ obtained from the model's equations become equal.

Then, when retrieving the basic fuel injection amount from the mapped data at the same condition (i.e., Ne=Nel, Pb=Pb1) during engine transients, it will be the same as that under the steady-state engine operating conditions as shown in Eq. 11.

$$Ti1 = \text{MAPPED DATA (Nel, Pb1)} \qquad \text{Eq. 11}$$

On the other hand, the basic fuel injection amount Ti2′ determined from the model equations are expressed as Eq. 12 and will not be the same as the value retrieved from the mapped data.

$$Ti2' = Gth2 \cdot \Delta T/14.7 - \Delta Gb2/14.7 \qquad \text{Eq. 12}$$

where $$Gth2 = A2 \cdot \rho 1 \cdot \sqrt{2g \frac{Pa - Pb1}{\gamma_1}}$$

In order to solve the discrepancy therebetween, it therefore becomes necessary to conduct complicate calculations based on the fluid dynamic model.

Figure 10:
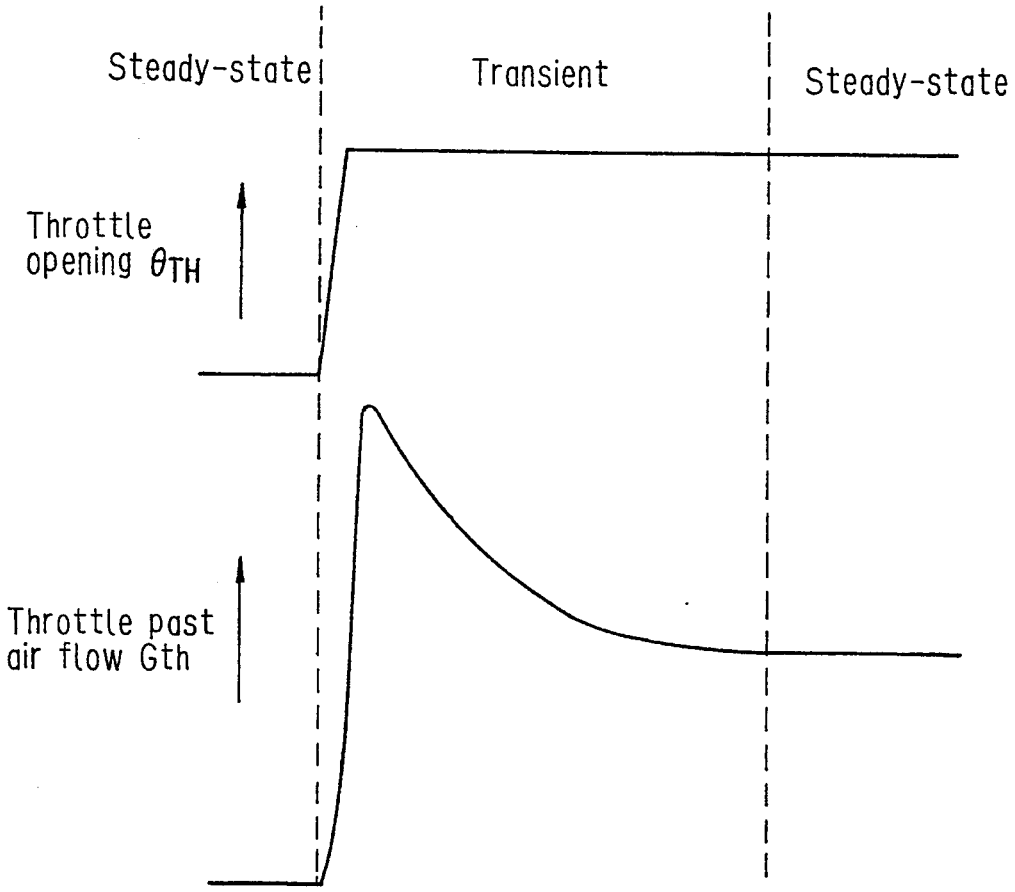
FIG. 10 is a timing chart explaining transient engine operating conditions referred to in the specification.

It should be noted here that "engine transients" are used to mean in the specification transient states between the steady-state engine operating conditions as illustrated in FIG. 10. Intrinsically, the air mass flow rate past the throttle is solely determined from engine speed Ne and throttle opening θTH. Such a condition is the steady-state engine operating condition. However, when the accelerator pedal is then depressed suddenly at that condition, the throttle valve is being opened at a relatively high speed as is shown in FIG. 10. Since, however, the change in manifold pressure is slower than the change in throttle valve, the pressure difference across the throttle valve becomes temporarily large for an instant notwithstanding the throttle valve is opened greatly. As a result, air mass flow, which should not happen at the throttle opening if engine is under steady-state operations, passes through the throttle valve to fill the chamber. The engine operation will then shift to new steady-state with the passage of time at which the air mass flow will again be solely determined from the engine speed and throttle opening. Such transient states are referred to as the engine transients or transient engine operating conditions in the specification.

Here, however, when comparing air mass flow Gth1 past the throttle under steady-state engine operating condition shown in Eq. 10 and air mass flow Gth2 past the throttle under transient engine operating condition shown in Eq. 12, it can be found that the difference is related only to the effective throttle opening area A. Accordingly, the throttle-past air mass flow Gth2 under the transient engine operating condition can be expressed as Eq. 13.

$$Gth2 = \frac{A2}{A1} Gth1 \qquad \text{Eq. 13}$$

In other words, this comes to mean that it is possible to determine the throttle-past air mass flow Gth2 under the transient operating condition from the product of the throttle-past air mass flow Gthl under steady-state engine operating condition and the ratio between the effective throttle opening areas A1, A2 of both conditions.

On the other hand, since the throttle-past air mass flow Gth1 under the steady-state engine operating condition can be obtained from the basic fuel injection amount Ti1 retrieved from the mapped data as shown in Eq. 14, the throttle-past air mass flow Gth2 under the transient engine operating condition can be obtained in the manner shown in Eq. 15.

$$\begin{aligned} Gth1 &= Ti1' \cdot 14.7/\Delta T \\ &= Ti1 \cdot 14.7/\Delta T \end{aligned} \qquad \text{Eq. 14}$$

$$Gth2 = \frac{A2}{A1} Ti1 \cdot 14.7/\Delta T \qquad \text{Eq. 15}$$

In other words, this comes to mean that the throttle-past air mass flow Gth2 under the transient engine operating conditions can accordingly be obtained from the same equation as that for the steady-state engine operating condition.

Using Eqs. 12 and 15, as a result, it becomes possible to determine the basic fuel injection amount Ti2' under the transient engine operating condition from the basic fuel injection amount Ti1 retrieved from the mapped data, the ratio A2/A1 between the effective throttle opening areas and a correction amount delta Ti corresponding to the chamber filling air mass flow delta Gb2, as expressed in Eq. 16.

$$Ti2' = \frac{A2}{A1} Ti1 - \Delta Ti$$

where

-continued $$\Delta Ti = (\Delta Gb2/14.7) \times k \qquad \text{Eq. 16}$$

In Eq. 16, "k" is a coefficient for converting fuel injection amount into injector's opening period.

Figure 11:
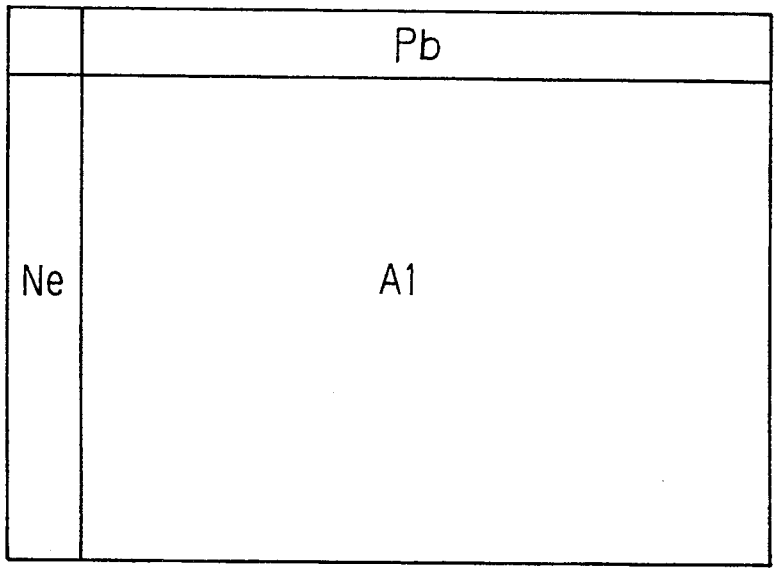
FIG. 11 is a view explaining mapped data of an effective throttle opening area A1 predetermined with respect to engine speed Ne and manifold pressure Pb.

In the embodiment, the effective throttle opening area A1 under the steady-state engine operating conditions is calculated in advance and stored as mapped data using engine speed Ne and manifold pressure Pb as address data as illustrated in FIG. 11 in a similar manner to the basic fuel injection amount Ti. Moreover, the amount delta Ti for correcting the basic fuel injection amount Ti is similarly prepared in advance and stored in the memory in such a manner that it can be retrieved by manifold pressure change delta Pb and the desired air/fuel ratio, as illustrated in FIG. 12. Here, the manifold pressure change delta Pb means the difference between detected manifold pressure Pb at the current detection cycle and that at the last detection cycle. As regards the desired air/fuel ratio, the same ratio as is used for the basic fuel injection amount Ti is to be selected for the correction amount delta Ti for harmonization.

Figure 13:
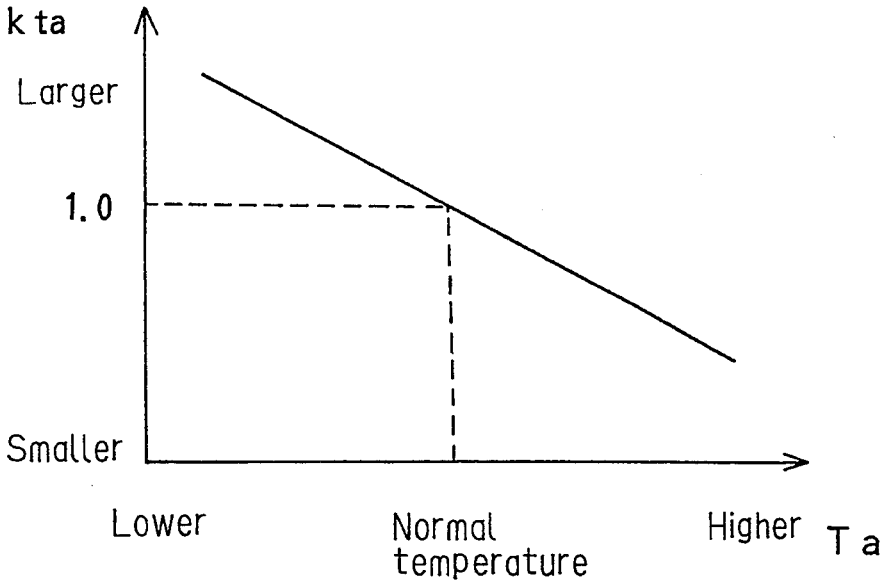
FIG. 13 is a view showing the characteristic of a coefficient kta of intake air temperature correction to be used for the correction amount delta Ti.

At the same time, intake air temperature's correction is conducted for the correction amount delta Ti retrieved from the mapped data. More specifically, a correction coefficient kta is retrieved from a table using detected intake air temperature Ta as address datum and the correction amount delta Ti is multiplied by the retrieved correction coefficient kta to correct the same. FIG. 13 shows the characteristic of the table. This is because the ideal gas law shown in Eq. 5 is used in the embodiment.

Figure 5:
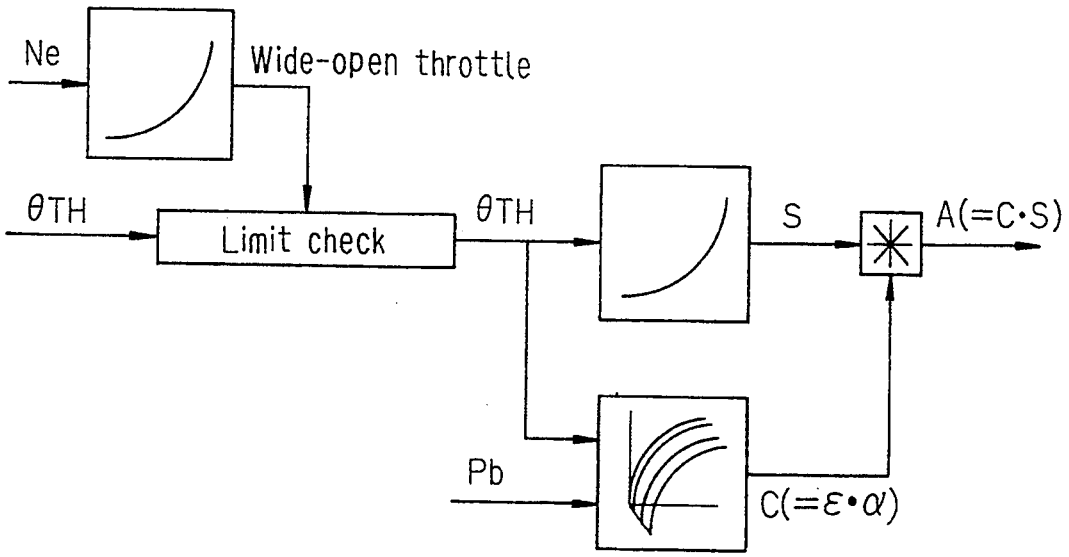
FIG. 5 is a block diagram showing the calculation of the effective throttle opening area obtained from throttle's projection area multiplied by the discharge coefficient.
Figure 6:
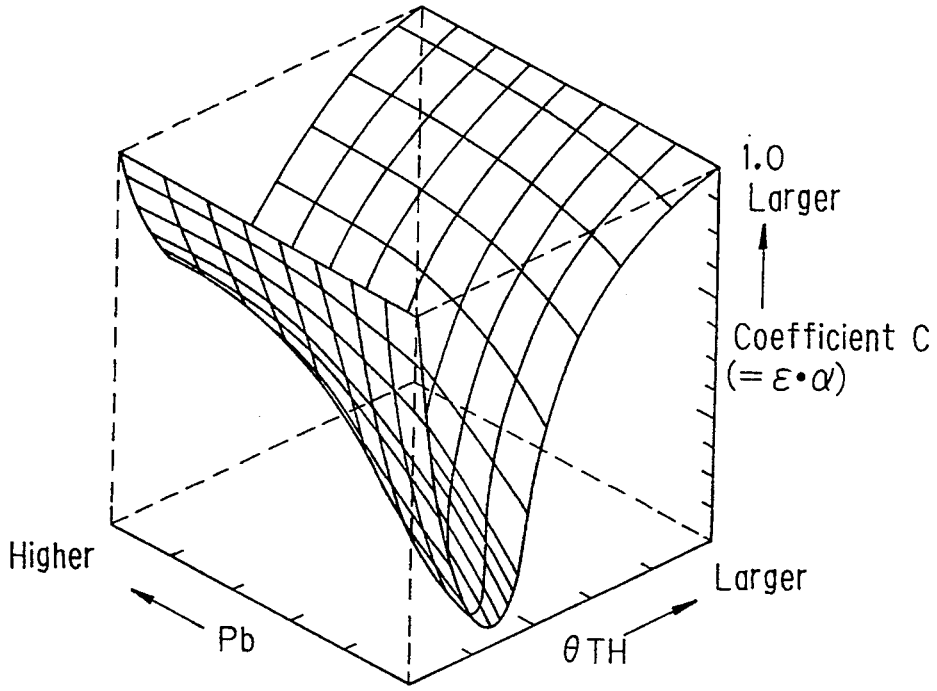
FIG. 6 is a view showing the characteristics of mapped data of the coefficient referred to in FIG. 5 predetermined with respect to manifold pressure and throttle opening.

And, as was illustrated in FIG. 5, the discharge coefficient C is retrieved from the mapped data shown in FIG. 6 using detected throttle opening $\theta$TH and manifold pressure Pb as address data. The throttle's projection area S retrieved from a table by the detected throttle opening $\theta$TH is then multiplied by the discharge coefficient C to calculate the current effective throttle opening area A2. Then the ratio A2/A1 is obtained and the basic fuel injection amount Ti is multiplied by the ratio and the correction amount delta Ti is subtracted from the product to determine an output fuel injection amount Tout. Under steady-state engine operating conditions in which manifold pressure does not change, the basic fuel injection amount Ti retrieved from the mapped data will immediately be the output fuel injection amount Tout as shown in Eq. 17. Under transient engine operating conditions, the output fuel injection amount Tout will be calculated according to the equation shown in Eq. 18.

$$\begin{aligned} Tout &= \frac{A2}{A1} Ti1 - 0 \\ &= Ti1 \end{aligned} \qquad \text{Eq. 17}$$

$$Tout = \frac{A2}{A1} Ti1 - \Delta Ti \qquad \text{Eq. 18}$$

The output fuel injection amount is thus determined even under transient engine operating conditions in the same manner as under the steady-state engine operating conditions, ensuring the continuity in the fuel metering control. Moreover, even when the effective throttle opening area A1 obtained from the mapped data retrieval does not coincide with the current effective throttle opening area A2 under steady-state engine operating conditions, the output fuel injection amount Tout will be determined as shown in Eq. 19, so that any factor such as mapped data's initial variance causing the discrepancy will then be automatically corrected.

$$Tout = \frac{A2}{A1} Ti1 - 0 \qquad \text{Eq. 19}$$

Based on the above, the operation of the system will be explained with reference to the flow chart of FIG. 3.

First in step S10 in which engine speed Ne obtained by counting the output of the crank angle sensor 34 is read in. The program then advances to step S12 in which other engine operating parameters such as manifold pressure Pb, throttle opening θTH or the like are read in, to step S14 in which it is checked if the engine is cranking. If not, the program advances to step S16 in which it is checked if fuel cut is in progress and if not, to step S18 in which the basic fuel injection amount Ti is retrieved from the mapped data shown in FIG. 8 and stored in the ROM 58 using the engine speed Ne and manifold pressure Pb read in. It should be noted here that the basic fuel injection amount Ti may then be subject to atmospheric pressure correction or the like. The correction itself is however not the gist of the invention and no explanation will here be made.

The program then proceeds to step S20 in which the effective throttle opening area A1 is retrieved from the mapped data shown in FIG. 11 using the same parameters as address data, to step S22 in which the current effective throttle opening area A2 is determined in the manner earlier explained, to step S24 in which the desired air/fuel ratio on which the basic fuel injection amount Ti is based, is retrieved from the mapped data shown in FIG. 9 using the engine speed Ne and manifold pressure Pb read in as address data, to step S26 in which the manifold pressure's change (difference) delta Pb is calculated, to step S28 in which the correction amount delta Ti is retrieved from the mapped data shown in FIG. 12 using the desired air/fuel ratio and the manifold pressure change delta Pb as address data. The program then moves to step S30 in which the correction amount delta Ti is multiplied by the coefficient kta to conduct the intake air temperature's correction, to step S32 in which the output fuel injection amount Tout is calculated in the manner illustrated, to step S34 in which the injector 22 for the cylinder concerned is driven to open for a period corresponding to the output fuel injection amount Tout. Although the output fuel injection amount Tout is subject beforehand to battery voltage correction or the like, that is also not the gist of the invention so that no explanation will here be made.

When it is found in step S14 that the engine is being cranked, the program passes to step S36 in which a fuel injection amount Ticr at cranking is retrieved from a table, not shown, using engine coolant temperature Tw as address datum, to step S38 in which the output fuel injection amount Tout is determined in accordance with an equation under engine cranking (explanation omitted). If it is found at step S16 the fuel cut is in progress, the program advances to step S40 in which the output fuel injection amount Tout is set to be zero.

Thus, with simple equations using values retrieved from the mapped data, it becomes possible in the embodiment to describe the entire engine operation conditions including engine transients by retrieving the mapped data. It becomes also possible in the embodiment to ensure the basic fuel injection amount to a considerable extent by the mapped data retrieval, and the fuel injection amount can therefore be determined optimally without conducting complicate calculations. Further, since the equations are not switched between the steady-state engine operating conditions and the transient engine operating conditions, and since the equations can describe the entire engine operating conditions, control's discontinuity, which would otherwise occur if the equations are switched between the steady-state and transient engine operations, will not happen. Furthermore, the output fuel injection amount is determined on the basis of the ratio between the current and predetermined effective throttle opening areas, even when a discrepancy results due to the system's degradation or initial manufacturing variances, it becomes possible to automatically correct it.

However, after validating the control through repeated computer simulations, it has been found that the effective throttle opening area A1 did not coincide with the current effective throttle area A2. Namely, the value A1 retrieved from the mapped data shown in FIG. 11 was not equal to the value A2 obtained primarily from the detected throttle opening θTH.

From the inventors' observation, the theory itself explained in the foregoing was true. However, the sensors and data mapping or computer performance were not free from manufacturing costs. For example, the data mappings were conducted by selecting lattice points and setting data thereon in the manner such as illustrated in FIG. 6. Values between the lattice points were obtained by interpolating the adjacent points' values, resulting the value not so accurate than required. The sensor 36 for detecting throttle opening θTH and the sensor 38 for detecting manifold pressure Pb were not so accurate in performance than expected due to the restriction in the manufacturing cost. In addition, detection timing was not the same for the individual sensors 36,38. Since the value A1 was retrieved from the parameters including manifold pressure Pb and the value A2 was obtained primarily from throttle opening θTH, the difference in detection timing would be a reason for the discrepancy between the values A1 and A2.

Further, it has been found through the validation that there is a lag in the behavior of the chamber filling air flow delta Gb. More specifically, the chamber filling air flow delta Gb was expected to simply increase with increasing the throttle-past air flow. Measuring the behavior of the chamber filling air flow delta Gb, however, it has been found that there is a lag until the change of the chamber filling air has been reflected to the cylinder air flow. The reason for this would be the inconsistency in the sensors detection timing just referred to and detection lag of the sensors, in particular the lag of the manifold absolute pressure sensor 38.

Figure 14:
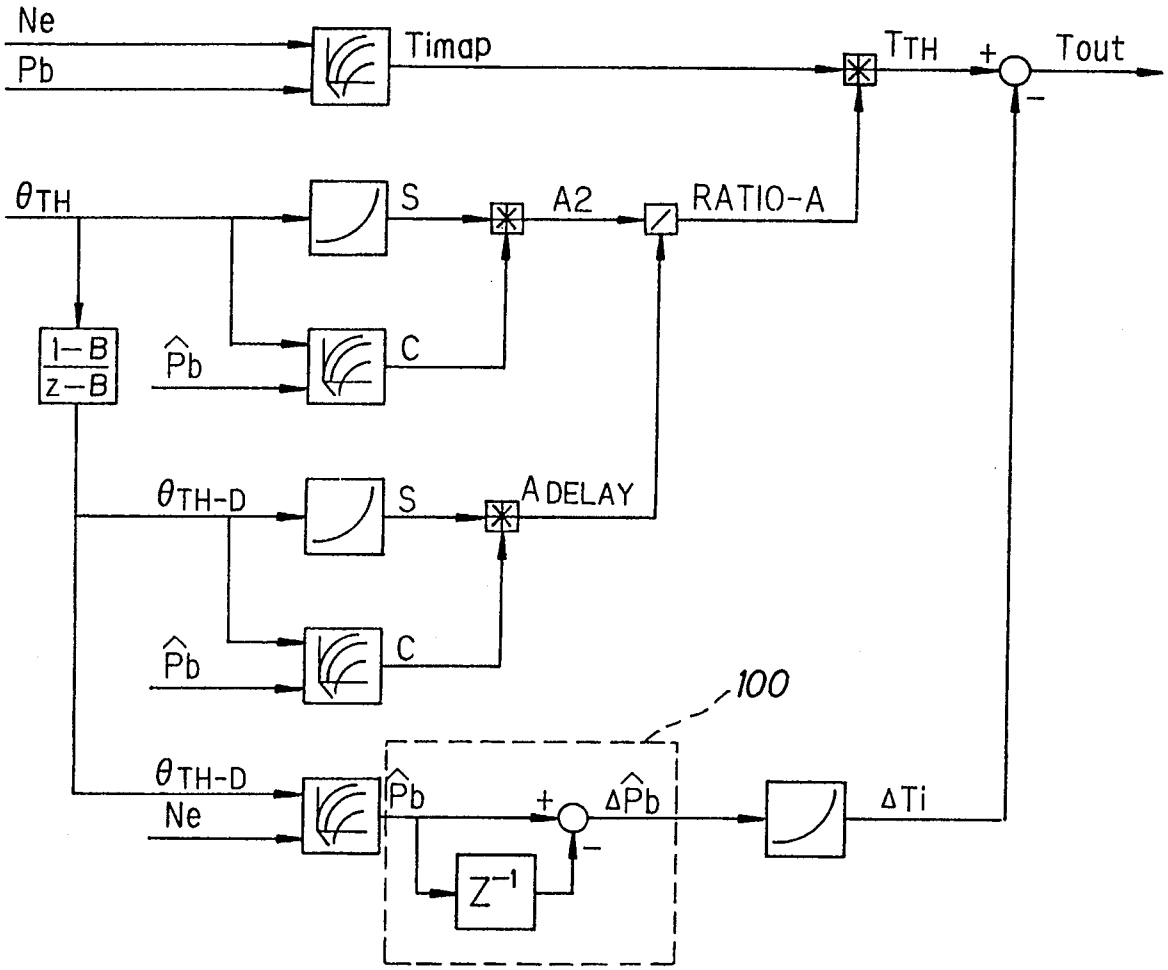
FIG. 14 is a block diagram showing the fuel metering control system according to the second embodiment of the invention.

Then, the inventors have observed the relationship between the throttle opening θTH and manifold pressure Pb. If engine speed is constant, it can be said that the manifold pressure is solely determined from the throttle opening when engine is under steady-state operations. During engine transients, it has been observed that the manifold pressure has the first-order lag relationship with respect to the change of the throttle opening. Based on the observation, as is illustrated in FIG. 14, the system is now rearranged such that the first-order lag of the throttle opening (the lag referred hereinafter to as "θTH-D"), is first obtained and from the value θTH-D and engine speed Ne, a second value is obtained in accordance with a predetermined characteristic. The second value is here deemed as a "pseudo manifold pressure", hereinafter referred to as "Pb with hat". With the arrangement, it has been found that the sensor detection timing's gap and the manifold pressure sensor's detection lag can be solved.

Figures 15, 15A:
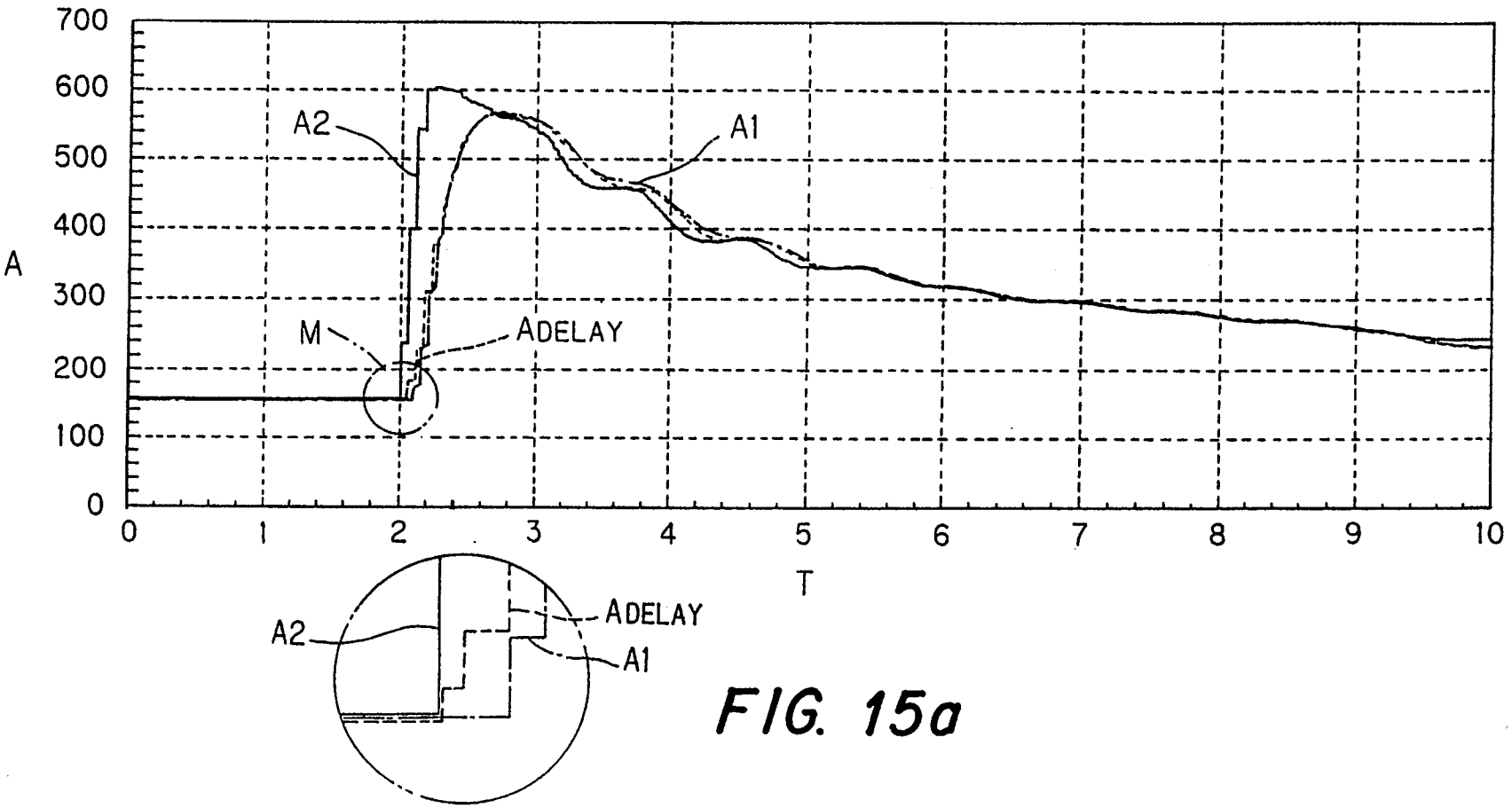
FIG. 15 is a timing chart showing an effective throttle opening area named ADELAY in contrast to the effective throttle opening area A1 used in the first embodiment.

Further, observing the behavior of the effective throttle opening area A1, the inventors came to the assumption that the aforesaid value A1 retrieved from the mapped data could be determined from the first-order lag of the current effective throttle opening area A2. And after verifying it through computer simulations, it was validated as shown in FIG. 15. To be more specific, if the first-order lag of the area A2 is called as "ADELAY", and when comparing A2/A1 with A2-/ADELAY, it becomes the comparison of A1 and ADELAY, provided that the value A2 is identical for both. If the throttle valve is opened rapidly, it can be found that the aforesaid value A1 retrieved by the manifold pressure and engine speed rises behind the rise of the current effective throttle opening are A2, whereas the value ADELAY follows the value 2A relatively faithfully, as is illustrated in the figure's magnified portion M of the figure. Accordingly, it is decided that, instead of the aforesaid ratio A2/A1, the ratio A2/first-order lag thereof (ADELAY) is used hereinafter. Under steady-state engine operations, with the arrangement, the value A2 becomes equal to its first-order lag ADELAY (formerly A1) and hence, the ratio does duly become 1. The ratio is hereinafter referred to as "RATIO-A".

Figure 16A:
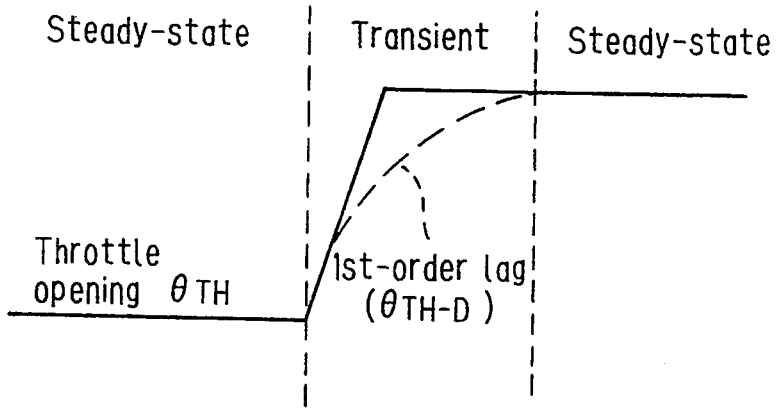
FIG. 16 is a timing chart explaining the effective throttle opening area ADELAY.
Figure 16B:
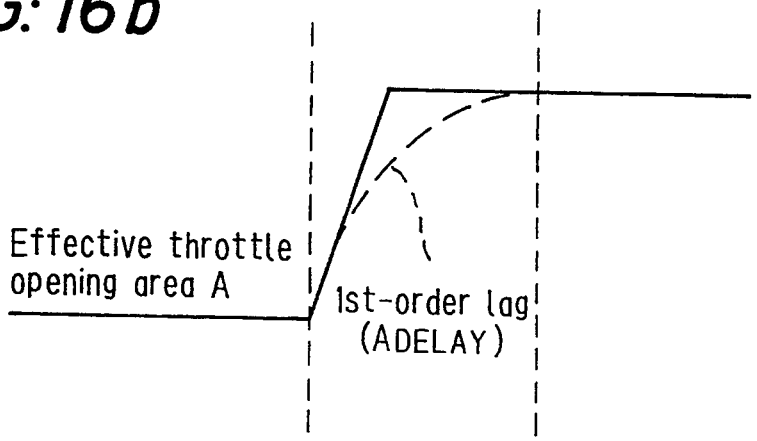

Furthermore, when viewing the relationship between the effective throttle opening area and the throttle opening, since the effective throttle opening area depends greatly on the throttle opening as was shown in Eq. 5, it is considered that the effective throttle opening area will vary almost faithfully following the change of the throttle opening, as illustrated in FIG. 16. If it is true, it can be said that the aforesaid throttle opening's first-order lag will nearly correspond to the effective throttle opening area's first-order lag.

In view of the above, it is arranged as illustrated in FIG. 14 such that, the effective throttle opening area ADELAY (initially to be calculated from the value A2) is calculated primarily from the first-order of the throttle opening. In the figure, it should be noted that $(1-B)/(z-B)$ is a transfer function of the discrete control system and means the value of the first-order lag.

As illustrated, namely, the throttle's projection area S is determined from the throttle opening θTH in accordance with a predetermined characteristics. The discharge coefficient C is determined from the throttle opening's first-order lag θTH-D and the pseudo manifold pressure Pb with hat in accordance with a characteristic similar to that shown in FIG. 6. Then the product of the values is obtained to determine the effective throttle opening area ADELAY. Thus, as shown in FIG. 14, the value of the throttle opening's first-order lag θTH-D is first used for determining the effective throttle opening area ADELAY and is second used to determine the pseudo manifold pressure Pb with hat with engine speed.

Figure 17:
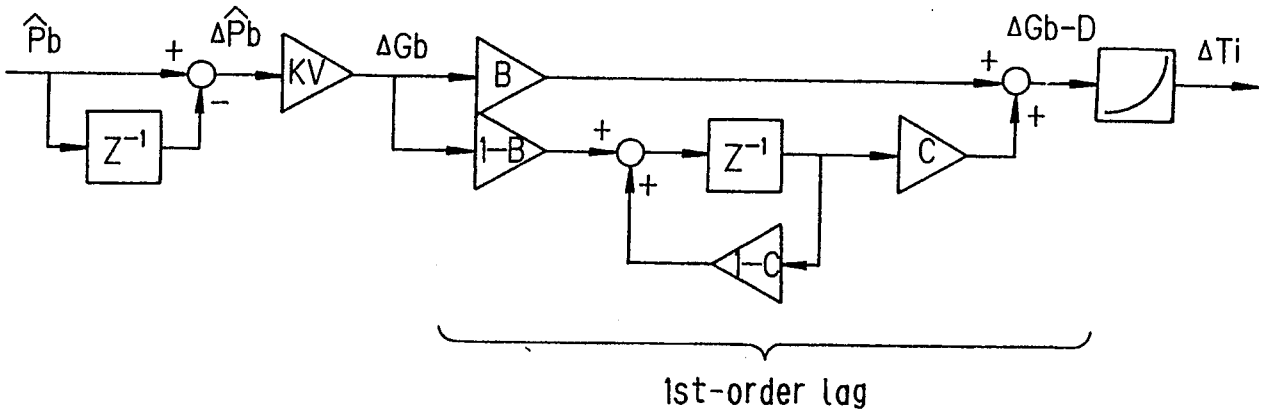
FIG. 17 is a block diagram showing the detailed structure of a portion of the block diagram illustrated in FIG. 14.

Furthermore, in order to solve the chamber filling air flow delta Gb's reflection lag to the cylinder air flow, the first-order lag of the value delta Gb is now be used. That is; as shown in FIG. 17 which is a block diagram showing the details of a portion 100 in FIG. 14, the value of the first-order lag of the chamber filling air flow delta Gb is obtained. The value is hereinafter referred to as "delta Gb-D". And based on the value delta Gb-D, the correction amount delta Ti is determined in accordance with Eq. 16. This will be done by pre-establishing a characteristic, not illustrated, similar to that shown in FIG. 12 with respect to the desired air/fuel ratio and the chamber filling air flow's first order lag delta Gb-D and by retrieving the value delta Ti by the parameters. It should be noted that in FIG. 17, time constants of the first-order lag are determined appropriately through tests.

Figure 18:
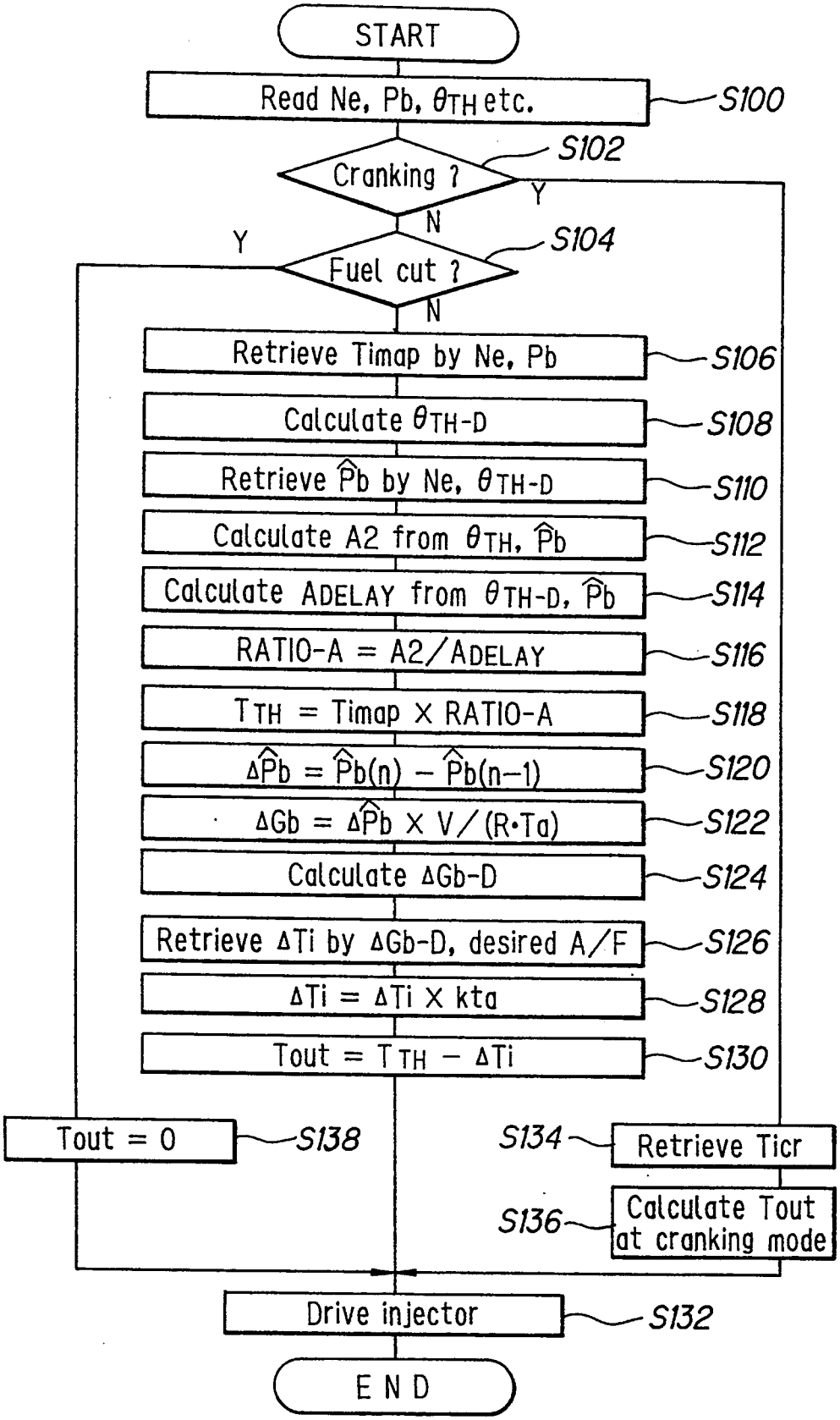
FIG. 18 is a flow chart showing the operation of the system according to the second embodiment of the invention.

FIG. 18 is a flow chart showing the control system just explained which is the second embodiment of the invention.

The program begins with step S100 and after passing through steps S100 to S104 similarly to the FIG. 3 flow chart in the first embodiment, the program proceeds to step S106 in which the basic fuel injection amount Timap is determined. It should be noted that the basic fuel injection amount Ti in the first embodiment is renamed as "Timap" in the second embodiment. The value is therefore the same as the value "Ti" in the first embodiment.

The program then proceeds to step S108 in which the throttle opening's first-order lag θTH-D is calculated, to step S110 in which the pseudo manifold pressure Pb with hat is retrieved from mapped data, whose characteristic is omitted from illustration, using the value θTH-D and engine speed Ne as address data, to step S112 in which the current effective throttle opening area A2 is calculated from the detected throttle opening θTH and the retrieved value Pb with hat. And the program proceeds to step S114 in which the effective throttle opening area's first order lag ADELAY is calculated from the value θTH-D and the value Pb with hat, to step S116 in which the RATIO-A is obtained in the manner illustrated, to step S118 in which the basic fuel injection amount Timap is multiplied by the ratio to determine a fuel injection amount TTH corresponding to the throttle-past air flow Gth concerned.

The program next advances to step S120 in which the difference between the value Pb with hat just retrieved in the current program cycle, here referred to as "Pb with hat (n)", and the value retrieved in the last program cycle, here referred to as "Pb with hat (n−1)" to determine its change named delta Pb with hat, to step S122 in which the chamber filling air flow's change delta Gb is calculated from the ideal gas law, to step S124 in which its smoothed value, i.e., its first-order lag delta Gb-D is calculated, to step S126 in which the correction amount delta Ti is retrieved from mapped data, whose characteristic is not illustrated but is similar to that shown in FIG. 12, using the value delta Gb-D and desired air/fuel ratio as address data.

The program then moves to step S128 in which the retrieved value delta Ti is subject to the air temperature's correction as is experienced in the first embodiment, to step S130 in which the fuel injection amount TTH is subtracted by the correction amount delta Ti to determine the output fuel injection amount Tout, to step S132 in which the injector 22 is driven in response thereto.

If step S102 finds the engine is being cranked, the program passes to steps S134 and S136, while if step S104 finds the fuel cut is being in progress, the program goes to step S138 similarly to the first embodiment.

In the second embodiment, the ratio between the effective throttle opening areas does properly become 1 in steady-state engine operating conditions. And the basic fuel injection amount Timap is determined from engine speed and manifold pressure in the same manner as the first embodiment, while the other values, i.e., RATIO-A and delta Ti are determined based solely on the throttle opening, the system structure is extremely simplified than that in the first embodiment and the aforesaid problems due to the detection timing gap between the manifold pressure sensor and the throttle position sensor and the manifold pressure sensor's detection lag can now been solved. Further, the behavior of the air flow has been described more accurately than that in the first embodiment, the fuel metering control has therefore been enhanced.

Figure 19:
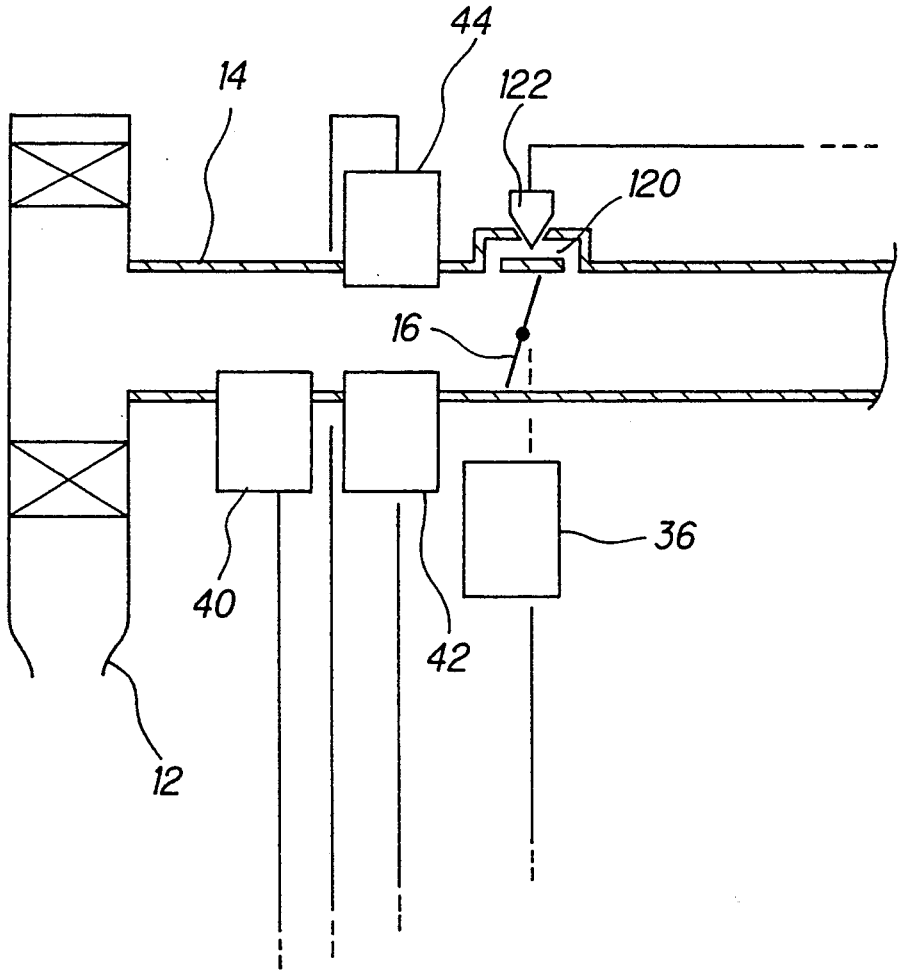
FIG. 19 is a view, similar to FIG. 1, but showing an engine used in the fuel metering control system according to the third embodiment of the invention.
Figure 20:
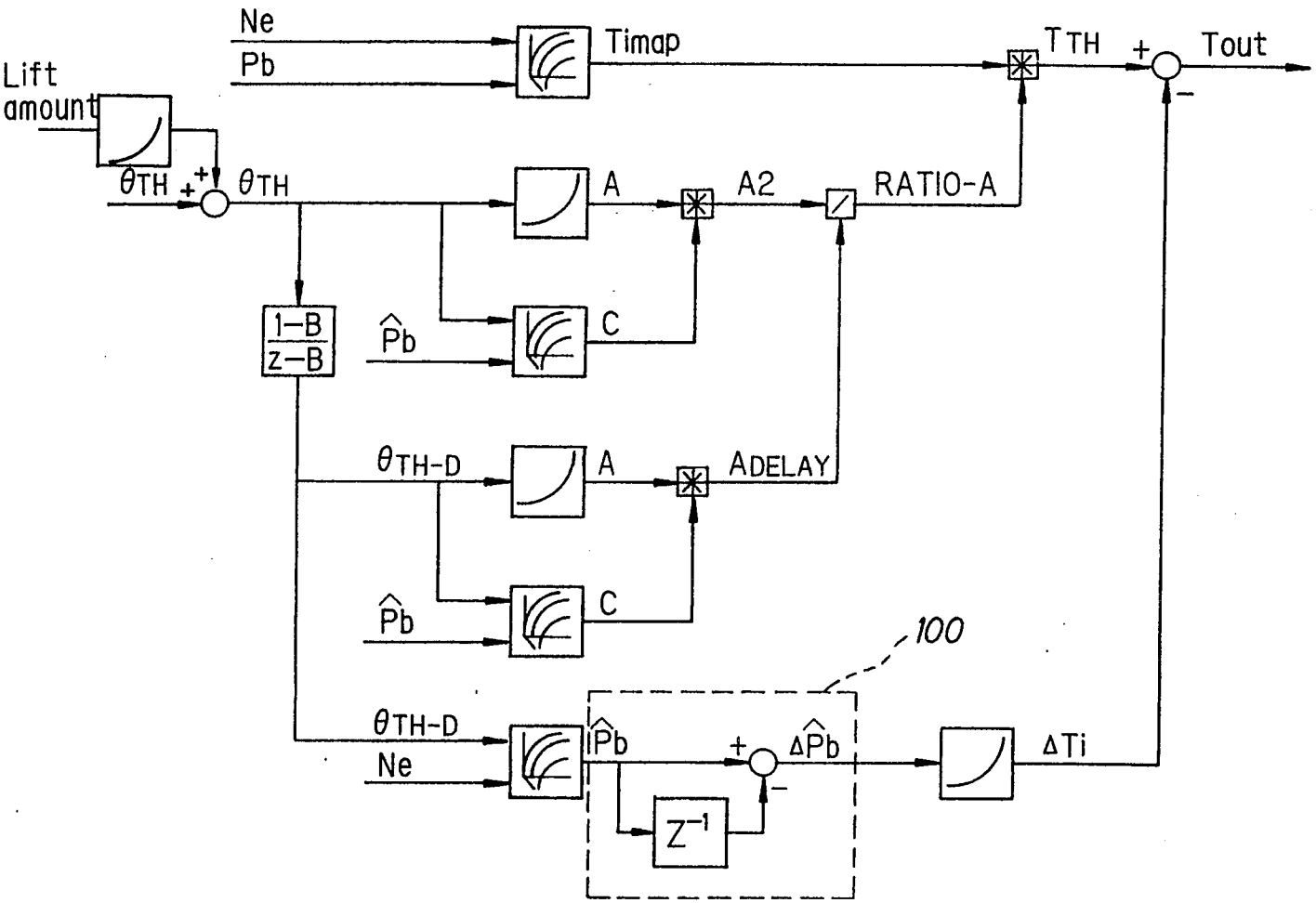
FIG. 20 is a block diagram, similar to FIG. 14, but showing the system according to the third embodiment of the invention.
Figure 21:
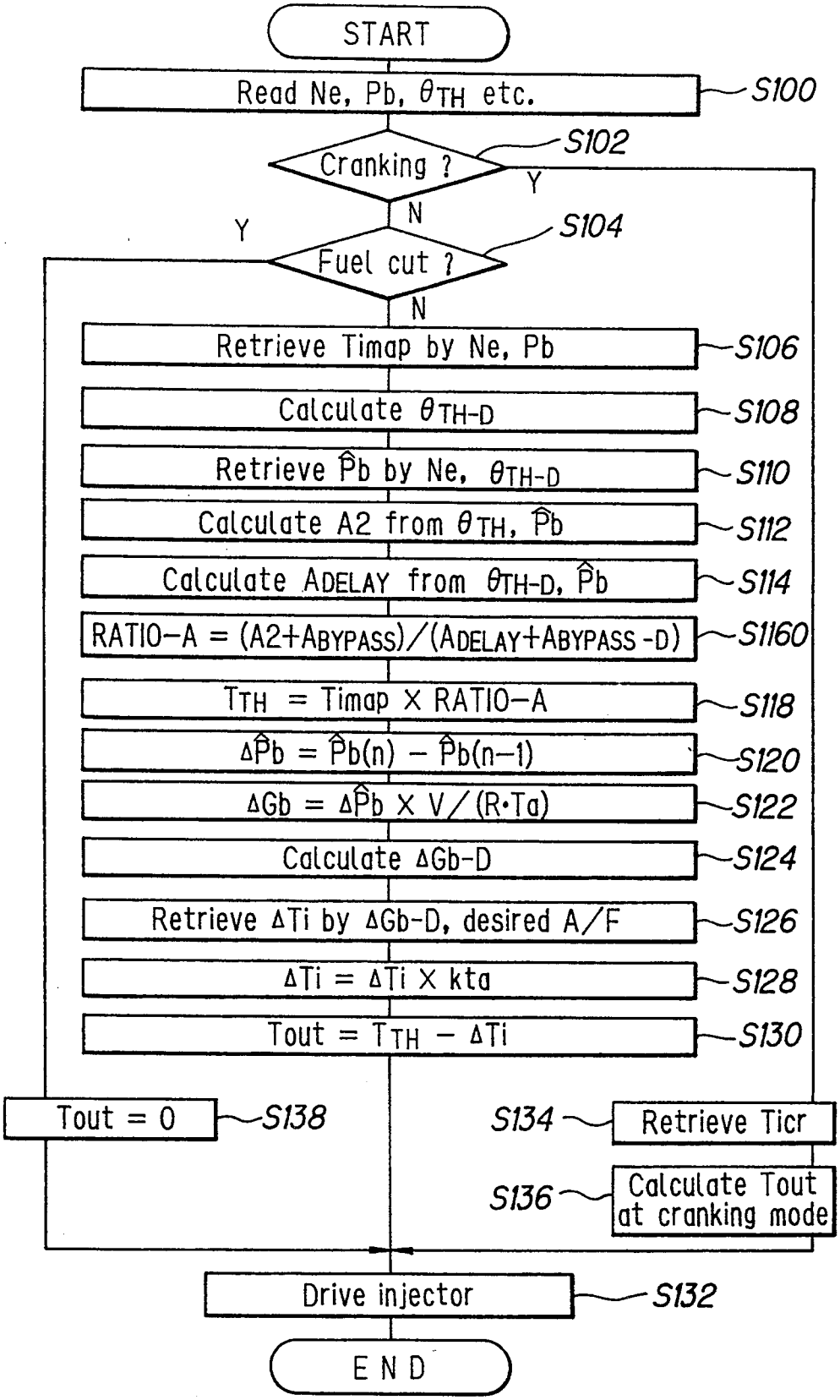
FIG. 21 is a flow chart showing the operation of the system according to the third embodiment of the invention.

FIGS. 19 to 21 shows the third embodiment of the invention. As illustrated in FIG. 19, when the air intake path 14 is provided with a bypass 120 having a valve 122 to be lifted up and down for idle control, cylinder air flow is not limited to that past the throttle valve 16. The same will also be applied to an engine having the so-called air-assist injector which introduces air to the injector to promote fuel's atomization. Strictly speaking, even in the engine as was illustrated in FIG. 1, when the throttle valve is fully closed against the throttle bore, a fraction of air can flow in the cylinder passing through a minute gap left between the throttle valve and throttle bore.

In the third embodiment, therefore, the amount of air flowing in the cylinder without passing through the throttle valve 16 is measured in advance and is taken into account in determining the fuel injection amount. To be more specific, the air flow not passing the throttle valve is measured and is converted to a value in terms of the throttle opening, referred hereinafter to as "lift amount" to be added to the throttle opening $\theta$TH in accordance with a characteristic appropriately set. More specifically, as shown in the flow chart of FIG. 21 illustrating the control of the third embodiment, in calculating the ratio RATIO-A, the numerator is added with a value named ABYPASS corresponding to the lift amount and defined in terms of the effective throttle opening area, while the denominator is added with the first-order lag named ABYPASS-D of the value ABYPASS. The rest of third embodiment is the same as the second embodiment.

With the arrangement, fuel metering control can further be improved in accuracy. Further, since the value is added to both the numerator and the denominator (more correctly, the denominator being added with its first-order lag), even if there happens an error in measuring the air flow not passing through the throttle valve, i.e. the lift amount, the determination of the fuel injection amount will not be affected insofar as the error is not so significant. Furthermore, although the explanation is only made to use the lift amount in calculating the ratio RATIO-A, the lift amount is, needless to say, used for obtaining other values including the pseudo manifold pressure Pb with hat.

In the second and third embodiments, in determining the first-order lag of the correction amount delta Ti, the first-order lag of the chamber filling air flow delta Gb is first calculated and the value delta Ti is then calculated therefrom in accordance with the characteristic similar to that shown in FIG. 12. The invention is not limited to the disclosure and it is alternatively possible to obtain the first-order lag of the pseudo manifold pressure delta Pb with hat or the value delta Ti itself.

It should be noted that although the correction amount delta Ti is prepared as mapped data, it is alternatively possible to obtain it by partially or wholly conducting the calculations.

It should also be noted that although the change of the pseudo manifold pressure delta Pb with hat is obtained from the difference between the values obtained at the current and last program cycles, it is alternatively possible to use a value obtained at the program cycle preceding thereto. Further it is alternatively possible to use a differential or a differential integral of the values.

It should further be noted that in the first to third embodiments, although the output fuel injection amount Tout is obtained by subtracting the correction amount delta Ti corresponding to the chamber filling air flow from the basic fuel injection amount Ti or Timap, it is alternatively possible to determine the output fuel injection amount Tout immediately from the basic fuel injection amount Ti or Timap, when the engine has only one cylinder with a little chamber volume enough to be neglected.

It should further be noted that in the first to third embodiments, although the basic fuel injection amount Ti or Timap is prepared as mapped data, it is alternatively possible to prepare, instead of the amount Ti or Timap, the throttle-past air flow Gth as mapped data. Although the alternative will be disadvantageous in that it could not absorb the change in the cylinder air flow due to pulsation or an error resulting when the injector's characteristic is not linear, it will nevertheless be possible to attain the object of the invention to some extent.

It should further be noted that in the first to third embodiments, although the values are obtained from the mapped data and tables, it is alternatively possible to obtain them by partially or wholly conducting calculations according to the equations.

While the invention has thus been shown and described with reference to the specific embodiments. However, it should be noted that the invention is in no way limited to the details of the described arrangements, changes and modifications may be made without departing from the scope of the appended claims.

What is claimed is:

1. A system for controlling fuel metering in an internal combustion engine on the basis of the air flowing to a cylinder of the engine determined on a fluid dynamic model describing the behavior of the air passing through a throttle provided in an air intake system of the engine, comprising;

first means for detecting operating parameters of the engine at least including engine speed, manifold pressure and throttle opening;

second means for determining a fuel injection amount (Ti) corresponding to the throttle-past air flow (Gth) under a steady-state engine operating condition at least from the engine speed and manifold pressure in accordance with a first predetermined characteristic, treating the difference between the steady-state engine operating condition and a transient engine operating condition as a difference in effective throttle opening areas;

third means for determining an effective throttle opening area (A1) under the steady-state engine operating condition in accordance with a second characteristic;

fourth means for determining a current effective throttle opening area (A2) on the basis of the throttle opening and manifold pressure to determine a ratio (A2/A1) between the effective throttle opening areas (A1, A2);

fifth means for multiplying the determined basic fuel injection amount (Ti) by the ratio (A2/A1) to determine an output injection amount (Tout); and sixth means for driving an injector to open for a period corresponding to the determined output fuel injection amount.

2. A system according to claim 1, wherein said current effective throttle opening area (A2) is determined by obtaining a throttle's projection area and by multiplying it by a coefficient determined from the throttle opening and manifold pressure.

3. A system according to claim 1, wherein said second characteristic for determining the effective throttle opening area A1 is predetermined in advance with respect to engine speed and manifold pressure.

4. A system according to claim 3, wherein said current effective throttle opening area (A2) is determined by obtaining a throttle's projection area and by multiplying it by a coefficient determined from the throttle opening and manifold pressure.

5. A system for controlling fuel metering in an internal combustion engine on the basis of the air flowing to a cylinder of the engine determined on a fluid dynamic model describing the behavior of the air passing through a throttle provided in an air intake system of the engine, comprising;

first means for detecting operating parameters of the engine at least including engine speed, manifold pressure and throttle opening;

second means for determining a basic fuel injection amount (Ti) corresponding to the throttle-past air flow (Gth) under a steady-state engine operating condition and an effective throttle opening area (A1) under the steady-state engine operating condition from the engine speed and manifold pressure in accordance with predetermined first and second characteristics, treating the difference between the steady-state engine operating condition and a transient engine operating condition as a difference in the effective throttle opening areas;

third means for determining a current effective throttle opening area (A2) on the basis of the throttle opening and manifold pressure;

fourth means for obtaining the change of the manifold pressure to determine an air flow (delta Gb) filling a chamber defined from downstream of the throttle to a portion immediately before the cylinder of the engine at least from the change of the manifold pressure on the basis of the ideal gas law, and then by dividing the chamber filling air flow (delta Gb) by a desired air/fuel ratio (A/F) to determine a correction amount delta Ti (=delta Gb/(A/F)) corresponding to the chamber filling air flow (delta Gb);

fifth means for obtaining a ratio (A2/A1) between the effective throttle opening areas (A1, A2) and for multiplying the determined basic fuel injection amount (Ti) by the ratio (A2/A1) and by subtracting from the product the correction amount (delta Ti) to determine an output fuel injection amount (Tout); and sixth means for driving a injector to open for a period corresponding to the determined output fuel injection amount (Tout).

6. A system according to claim 5, wherein said current effective throttle opening area (A2) is determined by obtaining a throttle's projection area and by multiplying it by a coefficient determined from the throttle opening and manifold pressure.

7. A system according to claim 5, wherein said correction amount (delta Ti) is determined in accordance with a characteristic predetermined in advance with respect to the change of the manifold pressure and the desired air/fuel ratio.

8. A system according to claim 7, wherein said current effective throttle opening area (A2) is determined by obtaining a throttle's projection area and by multiplying it by a coefficient determined from the throttle opening and manifold pressure.

9. A system for controlling fuel metering in an internal combustion engine on the basis of the air flowing to a cylinder of the engine determined on a fluid dynamic model describing the behavior of the air passing through a throttle provided in an air intake system of the engine, comprising;

first means for detecting operating parameters of the engine at least including engine speed, manifold pressure and throttle opening;

second means for determining a fuel injection amount (Timap) under a steady-state engine operating condition at least from the engine speed and manifold pressure in accordance with a predetermined first characteristic;

third means for determining a first effective throttle opening area (A) at least from a value obtained from the throttle opening;

fourth means for obtaining a second effective throttle opening area (ADELAY) in accordance with a predetermined second characteristic;

fifth means for obtaining a ratio (A/ADELAY) between the first and second effective throttle opening areas (A, ADELAY) and for multiplying the determined fuel injection amount (Timap) by the ratio (A/ADELAY) to determine an output fuel injection amount (Tout) from the product as $$Tout = Timap \times (A/ADELAY); \text{ and}$$

sixth means for driving an injector to open for a period corresponding to the output fuel injection amount (Tout).

10. A system according to claim 9, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as $$Tout = Timap \times (A + ABYPASS)/(ADELAY + ABYPASS\text{-}D).$$

11. A system according to claim 10, wherein said fifth means determines the value (ABYPASS-D) at least from the first-order lag of the value (ABYPASS) in accordance with the predetermined fifth characteristic.

12. A system according to claim 9, wherein said third means determines a throttle's projection area at least from the throttle opening in accordance with a predetermined sixth characteristic, and by multiplying the throttle's projection area by a coefficient determines the effective throttle opening area (A).

13. A system according to claim 12, wherein said third means determines a pseudo manifold pressure in accordance with a predetermined seventh characteristic and obtains the coefficient (C) at least from the throttle opening and pseudo manifold pressure in accordance with a predetermined eighth characteristic.

14. A system according to claim 13, wherein said third means obtains a value (θTH-D) obtained at least from the first-order lag of the throttle opening to determine the pseudo manifold pressure at least from the value (θTH-D) and the engine speed in accordance with the predetermined seventh characteristic.

15. A system according to claim 9, wherein said fifth means obtains a value (delta Ti-D) in accordance with a predetermined fourth characteristic and determines the output fuel injection amount (Tout) as Tout=Timap (A/ADELAY)−delta Ti-D.

16. A system according to claim 15, wherein said fifth means obtains the value (delta Ti-D) in accordance with the predetermined fourth characteristic at least from the first-order lag of the correction amount (delta Ti) corresponding to an air flow (delta Gb) filling a chamber defined from the downstream of the throttle to a portion just before the cylinder of the engine on the basis of the ideal gas law.

17. A system according to claim 15, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amounts (Tout) as Tout=Timap×(A+ABYPASS)-
/(ADELAY+ABYPASS-D).

18. A system according to claim 17, wherein said fifth means determines the value (ABYPASS-D) at least from the first-order lag of the value (ABYPASS) in accordance with the predetermined fifth characteristic.

19. A system according to claim 9, wherein said fifth means determines an air flow (delta Gb) filling a chamber defined from the downstream of the throttle to a portion just before the cylinder of the engine on the basis of the ideal gas law, then determines a correction amount (delta Ti) corresponding to the chamber filling air flow (delta Gb), and by subtracting the correction amount (delta Ti) from the product to determine the output fuel injection amount (Tout) as Tout=Timap×(A/ADELAY)−delta Ti.

20. A system according to claim 19, wherein said fifth means obtains a value (delta Ti-D) in accordance with a predetermined fourth characteristic and determines the output fuel injection amount (Tout) as Tout=Timap (A/ADELAY)−delta Ti-D.

21. A system according to claim 20, wherein said fifth means obtains the value (delta Ti-D) at least from the first-order lag of the correction amount (delta Ti) in accordance with the predetermined fourth characteristic.

22. A system according to claim 19, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as Tout=Timap×(A+ABYPASS)-
/(ADELAY+ABYPASS-D).

23. A system according to claim 22, wherein said fifth means determines the value (ABYPASS-D) at least from the first-order lag of the value (ABYPASS) in accordance with the predetermined fifth characteristic.

24. A system according to claim 19, wherein said fifth means determines a pseudo manifold pressure (Pb with hat) in accordance with a predetermined third characteristic, and by obtaining the change of the pseudo manifold pressure (delta Pb with hat), determines the chamber filling air flow (delta Gb) on the basis of the ideal gas law to determine the correction amount (delta Ti).

25. A system according to claim 24, wherein said fifth means obtains a value (delta Ti-D) in accordance with a predetermined fourth characteristic and determines the output fuel injection amount (Tout) as Tout=Timap (A/ADELAY)−delta Ti-D.

26. A system according to claim 25, wherein said fifth means obtains the value (delta Ti-D) at least from the first-order lag of the correction amount (delta Ti) in accordance with the predetermined fourth characteristic.

27. A system according to claim 24, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as Tout=Timap×(A+ABYPASS)-
/(ADELAY+ABYPASS-D).

28. A system according to claim 27, wherein said fifth means determines the value (ABYPASS-D) at least from the first-order lag of the value (ABYPASS) in accordance with the predetermined fifth characteristic.

29. A system according to claim 24, wherein said fifth means obtains a value (θTH-D) obtained at least from the first-order lag of the throttle opening to determine the pseudo manifold pressure (Pb with hat) at least from the value (θTH-D) and the engine speed in accordance with the predetermined third characteristic.

30. A system according to claim 29, wherein said fifth means obtains a value (delta Ti-D) in accordance with a predetermined fourth characteristic and determines the output fuel injection amount (Tout) as Tout=Timap (A/ADELAY)−delta Ti-D.

31. A system according to claim 30, wherein said fifth means obtains the value (delta Ti-D) at least from the first-order lag of the correction amount (delta Ti) in accordance with the predetermined fourth characteristic.

32. A system according to claim 9, wherein said fourth means obtains the second effective throttle opening area (ADELAY) at least from the first-order lag of the first effective throttle opening area (A) in accordance with the predetermined second characteristic.

33. A system according to claim 32, wherein said fifth means obtains a value (delta Ti-D) in accordance with a predetermined fourth characteristic and determines the output fuel injection amount (Tout) as Tout=Timap (A/ADELAY)−delta Ti-D.

34. A system according to claim 33, wherein said fifth means obtains the value (delta Ti-D) in accordance with the predetermined fourth characteristic at least from the first-order lag of the correction amount (delta Ti) corresponding to an air flow (delta Gb) filling a chamber defined from the downstream of the throttle to a portion just before the cylinder of the engine on the basis of the ideal gas law.

35. A system according to claim 32, wherein said fifth means determines a value (ABYPASS) corresponding to an air flow not passing through the throttle and defined in terms of the effective throttle opening area and by adding the value (ABYPASS) to the numerator of the ratio (A/ADELAY and a value (ABYPASS-D) obtained in accordance with a predetermined fifth characteristic to the denominator thereof, determines the output fuel injection amount (Tout) as Tout=Timap×(A+ABYPASS)-
/(ADELAY+ABYPASS-D).

36. A system according to claim 35, wherein said fifth means determines the value (ABYPASS-D) at least from the first-order lag of the value (ABYPASS) in accordance with the predetermined fifth characteristic.

37. A system according to claim 32, wherein said fifth means determines an air flow (delta Gb) filling a chamber defined from the downstream of the throttle to a portion just before the cylinder of the engine on the basis of the ideal gas law, then determines a correction amount (delta Ti) corresponding to the chamber filling air flow (delta Gb), and by subtracting the correction amount (delta Ti) from the product to determine the output fuel injection amount (Tout) as Tout=Timap×(A/ADELAY)−delta Ti.

38. A system according to claim 37, wherein said fifth means obtains a value (delta Ti-D) in accordance with a predetermined fourth characteristic and determines the output fuel injection amount (Tout) as Tout=Timap (A/ADELAY)−delta Ti-D.

39. A system according to claim 38, wherein said fifth means obtains the value (delta Ti-D) at least from the first-order lag of the correction amount (delta Ti) in accordance with the predetermined fourth characteristic.

40. A system according to claim 37, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as Tout=Timap×(A+ABYPASS)-
/(ADELAY+ABYPASS-D).

41. A system according to claim 40, wherein said fifth means determines the value (ABYPASS-D) at least from the first-order lag of the value (ABYPASS) in accordance with the predetermined fifth characteristic.

42. A system according to claim 37, wherein said fifth means determines a pseudo manifold pressure (Pb with hat) in accordance with a predetermined third characteristic, and by obtaining the change of the pseudo manifold pressure (delta Pb with hat), determines the chamber filling air flow (delta Gb) on the basis of the ideal gas law to determine the correction amount (delta Ti).

43. A system according to claim 42, wherein said fifth means obtains a value (θTH-D) obtained at least from the first-order lag of the throttle opening to determine the pseudo manifold pressure (Pb with hat) at least from the value (θTH-D) and the engine speed in accordance with the predetermined third characteristic.

44. A system according to claim 42, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as Tout=Timap×(A+ABYPASS)-
/(ADELAY+ABYPASS-D).

45. A system according to claim 44, wherein said fifth means determines the value (ABYPASS-D) at least from the first-order lag of the value (ABYPASS) in accordance with the predetermined fifth characteristic.

46. A system according to claim 32, wherein said fourth means obtains the second effective throttle opening area (ADELAY) at least from a value (θTH-D) obtained at least from the first-order lag of the throttle opening in accordance with the predetermined second characteristic.

47. A system according to claim 46, wherein said fifth means obtains a value (delta Ti-D) in accordance with a predetermined fourth characteristic and determines the output fuel injection amount (Tout) as Tout=Timap (A/ADELAY)−delta Ti-D.

48. A system according to claim 47, wherein said fifth means obtains the value (delta Ti-D) in accordance with the predetermined fourth characteristic at least from the first-order lag of the correction amounts (delta Ti) corresponding to an air flow (delta Gb) filling a chamber defined from the downstream of the throttle to a portion just before the cylinder of the engine on the basis of the ideal gas law.

49. A system according to claim 46, wherein said fifth means determines a value (ABYPASS) corresponding to an air flow not passing through the throttle and defined in terms of the effective throttle opening area and by adding the value (ABYPASS) to the numerator of the ratio (A/ADELAY) and a value (ABYPASS-D) obtained in accordance with a predetermined fifth characteristic to the denominator thereof, determines the output fuel injection amount (Tout) as $$Tout = Timap \times (A + ABYPASS) / (ADELAY + ABYPASS\text{-}D).$$

50. A system according to claim 49, wherein said fifth means determines the value (ABYPASS-D) at least from the first-order lag of the value (ABYPASS) in accordance with the predetermined fifth characteristic.

51. A system according to claim 46, wherein said fifth means determines an air flow (delta Gb) filling a chamber defined from the downstream of the throttle to a portion just before the cylinder of the engine on the basis of the ideal gas law, then determines a correction amount (delta Ti) corresponding to the chamber filling air flow (delta Gb), and by subtracting the correction amount (delta Ti) from the product to determine the output fuel injection amount (Tout) as $$Tout = Timap \times (A/ADELAY) - \text{delta Ti}.$$

52. A system according to claim 51, wherein said fifth means determines a pseudo manifold pressure (Pb with hat) in accordance with a predetermined third characteristic, and by obtaining the change of the pseudo manifold pressure (delta Pb with hat), determines the chamber filling air flow (delta Gb) on the basis of the ideal gas law to determine the correction amount (delta Ti).

53. A system according to claim 52, wherein said fifth means obtains a value ($\theta$TH-D) obtained at least from the first-order lag of the throttle opening to determine the pseudo manifold pressure (Pb with hat) at least from the value ($\theta$TH-D) and the engine speed in accordance with the predetermined third characteristic.

54. A system according to claim 51, wherein said fifth means obtains a value (delta Ti-D) in accordance with a predetermined fourth characteristic and determines the output fuel injection amount (Tout) as $$Tout = Timap\ (A/ADELAY) - \text{delta Ti-D}.$$

55. A system according to claim 54, wherein said fifth means obtains the value (delta Ti-D) at least from the first-order lag of the correctLion amount (delta Ti) in accordance with the predetermined fourth characteristic.

* * * * *